US010464098B2

(12) United States Patent
Saine

(10) Patent No.: US 10,464,098 B2
(45) Date of Patent: Nov. 5, 2019

(54) REMOTE METERING STATION

(71) Applicant: NORDSON CORPORATION, Westlake, OH (US)

(72) Inventor: Joel E. Saine, Dahlonega, GA (US)

(73) Assignee: Nordson Corporation, Westlake, OH (US)

( * ) Notice: Subject to any disclaimer, the term of this patent is extended or adjusted under 35 U.S.C. 154(b) by 0 days.

(21) Appl. No.: 15/698,137

(22) Filed: Sep. 7, 2017

(65) Prior Publication Data

US 2018/0065142 A1 Mar. 8, 2018

Related U.S. Application Data

(60) Provisional application No. 62/385,238, filed on Sep. 8, 2016, provisional application No. 62/480,608, filed on Apr. 3, 2017.

(51) Int. Cl.
*B05C 11/00* (2006.01)
*B05C 11/10* (2006.01)
(Continued)

(52) U.S. Cl.
CPC ..... *B05C 11/1044* (2013.01); *B05B 7/16* (2013.01); *B05B 12/04* (2013.01); *B05C 5/0208* (2013.01);
(Continued)

(58) Field of Classification Search
CPC ..... B05C 11/1044; B05C 11/1002; B05C 11/1013; B05C 11/1042; B05B 12/04; B05B 7/16
(Continued)

(56) References Cited

U.S. PATENT DOCUMENTS 5,236,641 A 8/1993 Allen et al.
5,409,642 A 4/1995 Allen et al.
(Continued)

FOREIGN PATENT DOCUMENTS

DE 4121792 A1 1/1993
DE 202004001480 U1 4/2004
(Continued)

OTHER PUBLICATIONS

ISA/220—Notification of Transmittal or Search Report and Written Opinion of the ISA, or the Declaration dated Jan. 8, 2018 for WO Application No. PCT/US17/050380.
(Continued)

*Primary Examiner* — Lien M Ngo
(74) *Attorney, Agent, or Firm* — Baker & Hostetler LLP

(57) ABSTRACT

A remote metering station for pumping a flow of adhesive to a dispensing module is disclosed. The remote metering station includes a manifold having a front surface, a back surface opposite to the front surface, a first side surface, a second side surface opposite the first side surface, a top surface, and a bottom surface opposite to said top surface. The remote metering station also includes a modular pump assembly removably mounted to the manifold, where the modular pump assembly includes a bottom surface, an outlet on the bottom surface, the outlet being in fluid communication with the manifold, and an inlet for receiving the adhesive. The modular pump assembly further includes a gear assembly and a drive motor coupled to the gear assembly. The gear assembly is operable for pumping the adhesive from the inlet to the outlet.

15 Claims, 15 Drawing Sheets

(51) Int. Cl.
*B05B 7/16* (2006.01)
*B05B 12/04* (2006.01)
*B05C 5/02* (2006.01)

(52) U.S. Cl.
CPC ..... *B05C 11/1002* (2013.01); *B05C 11/1013* (2013.01); *B05C 11/1042* (2013.01)

(58) Field of Classification Search
USPC ..... 222/318, 225, 330, 504, 559, 565; 118/411; 239/128, 122, 134, 135, 267, 239/268, 550, 551
See application file for complete search history.

(56) References Cited

U.S. PATENT DOCUMENTS

| | | | | |
|---|---|---|---|---|
| 5,620,315 | A | 4/1997 | Pfuhler | |
| 5,727,933 | A * | 3/1998 | Laskaris | A62C 5/02 417/212 |
| 5,862,986 | A | 1/1999 | Bolyard et al. | |
| 6,089,413 | A | 7/2000 | Riney et al. | |
| 6,210,141 | B1 | 4/2001 | Allen | |
| 6,296,463 | B1 | 10/2001 | Allen | |
| 6,422,428 | B1 * | 7/2002 | Allen | B05B 7/0807 222/255 |
| 6,517,891 | B1 | 2/2003 | Estelle et al. | |
| 6,607,104 | B2 | 8/2003 | McGuffey | |
| 6,688,498 | B1 * | 2/2004 | McGuffey | B05C 5/0279 222/333 |
| 7,699,243 | B2 | 4/2010 | Starke | |
| 7,908,997 | B2 * | 3/2011 | Lessley | B05C 5/0279 118/411 |
| 8,445,061 | B2 | 5/2013 | McGuffey | |
| 8,561,656 | B2 * | 10/2013 | Eginton | B65B 57/145 141/104 |
| 9,126,222 | B2 * | 9/2015 | McGuffey | B05C 5/0225 |
| 9,415,415 | B1 | 8/2016 | Jones | |
| 9,427,766 | B2 * | 8/2016 | Varga | B05C 5/001 |
| 9,573,159 | B2 | 2/2017 | McGuffey | |
| 9,889,599 | B2 * | 2/2018 | Ayers | B29C 65/4815 |
| 9,925,552 | B2 | 3/2018 | Saine | |
| 2001/0024618 | A1 * | 9/2001 | Winmill | F04C 14/185 418/1 |
| 2002/0102324 | A1 | 8/2002 | Groleau | |
| 2002/0139818 | A1 | 10/2002 | McGuffey | |
| 2003/0062384 | A1 | 4/2003 | McGuffey | |
| 2004/0099752 | A1 * | 5/2004 | Boger | B05C 5/0279 239/548 |
| 2004/0124251 | A1 | 7/2004 | Gressett et al. | |
| 2004/0159672 | A1 | 8/2004 | Auber et al. | |
| 2005/0230423 | A1 | 10/2005 | Riney et al. | |
| 2005/0242108 | A1 | 11/2005 | Harris et al. | |
| 2005/0274317 | A1 | 12/2005 | De et al. | |
| 2006/0182887 | A1 * | 8/2006 | Miller | B05C 5/001 427/256 |
| 2008/0135650 | A1 | 6/2008 | Starke | |
| 2012/0048447 | A1 | 3/2012 | Burmester et al. | |
| 2015/0190837 | A1 * | 7/2015 | Burmester | G01F 15/006 222/71 |
| 2015/0352588 | A1 | 12/2015 | Lessley et al. | |
| 2016/0256889 | A1 | 9/2016 | Jones | |
| 2016/0303597 | A1 * | 10/2016 | McGuffey | B05C 5/0279 |
| 2017/0097019 | A1 | 4/2017 | Afshari | |
| 2017/0146035 | A1 | 5/2017 | Afshari | |
| 2018/0065137 | A1 | 3/2018 | Saine | |
| 2018/0065139 | A1 | 3/2018 | Saine | |
| 2018/0065140 | A1 | 3/2018 | Saine et al. | |

FOREIGN PATENT DOCUMENTS

| | | | |
|---|---|---|---|
| EP | 1442798 | A2 | 8/2004 |
| EP | 2289633 | A2 | 3/2011 |
| EP | 3064279 | A1 | 9/2016 |
| EP | 3064280 | A1 | 9/2016 |
| JP | 09-173917 | A | 7/1997 |
| WO | 93/05212 | A2 | 3/1993 |
| WO | 99/54055 | A1 | 10/1999 |
| WO | 2007/084891 | A2 | 7/2007 |
| WO | 2011/008390 | A1 | 1/2011 |
| WO | 2011/025603 | A1 | 3/2011 |

OTHER PUBLICATIONS

ISA/220—Notification of Transmittal or Search Report and Written Opinion of the ISA, or the Declaration dated Dec. 20, 2017 for WO Application No. PCT/US17/050373.

ISA/220—Notification of Transmittal or Search Report and Written Opinion of the ISA, or the Declaration dated Dec. 20, 2017 for WO Application No. PCT/US17/050368.

ISA/206—Invitation to Pay Additional Fees dated Jan. 5, 2018 for WO Application No. PCT/US17/50406.

International Patent Application No. PCT/US2017/050406; Int'l Search Report and the Written Opinion; dated Mar. 19, 2018; 19 pages.

(IPEA/408) Written opinion under Chapter II dated Aug. 3, 2018 for WO Application No. PCT/US17/050417.

English Translation of International Preliminary Report on Patentability Chapter II or English Translation of International Preliminary Report on Patentability Chapter I dated Dec. 13, 2018 for WO Application No. PCT/US17/050417.

(IPEA/409) International Preliminary Report on Patentability Chapter II or (IB/373) International Preliminary Report on Patentability Chapter I dated Mar. 21, 2019 for WO Application No. PCT/US17/050509.

(IPEA/409) International Preliminary Report on Patentability Chapter II or (IB/373) International Preliminary Report on Patentability Chapter I dated Mar. 21, 2019 for WO Application No. PCT/US17/050406.

(IPEA/409) International Preliminary Report on Patentability Chapter II or (IB/373) International Preliminary Report on Patentability Chapter I dated Mar. 21, 2019 for WO Application No. PCT/US17/050380.

(IPEA/409) International Preliminary Report on Patentability Chapter II or (IB/373) International Preliminary Report on Patentability Chapter I dated Mar. 21, 2019 for WO Application No. PCT/US17/050373.

(IPEA/409) International Preliminary Report on Patentability Chapter II or (IB/373) International Preliminary Report on Patentability Chapter I dated Mar. 21, 2019 for WO Application No. PCT/US17/050368.

* cited by examiner

REMOTE METERING STATION

CROSS REFERENCE TO RELATED APPLICATIONS

This application claims the benefit of U.S. Provisional Patent App. No. 62/385,238, filed Sep. 8, 2016, and the benefit of U.S. Provisional Patent App. No. 62/480,608, filed Apr. 3, 2017, the disclosures of which are hereby incorporated by reference herein.

TECHNICAL FIELD

The present invention relates to remote metering stations for pumping adhesive. More particularly, this invention relates to a remote metering station having a modular pump assembly that includes a pump and a drive motor unit.

BACKGROUND

Typical adhesive systems for applying hot-melt adhesives to a substrate include a melter that provides a supply of hot-melt adhesive. The adhesive can flow from the melter through hoses to any number of applicators, which each are capable of applying the adhesive to a substrate. However, the melter and applicators are typically spaced apart, which causes the adhesive to travel a distance between the melter and the applicators. As the distance between the melter and applicators increases, so does the actual volume of the soft inner core as an adverse reaction to changes in pressure. As a result, when the adhesive ultimately reaches the applicators, the pressure is different than intended by the operator of the adhesive system. The pressure control device being located a great distances away from the applicator increases the reaction time of the pressure control device to adequately control pressure at the applicator as hose lengths increase. This variability in pressure can cause negative consequences, such as hammerhead, inconsistent add-on rates per product, and burn-through on heat-sensitive substrates. Additionally, the ability to add additional flow streams based upon increased applicator requirements can be limited. In conventional systems, for example, if a melter has an output capacity sufficient to supply four applicators, and the existing pump system includes four pumps, an additional melter must be utilized to supply any additional flow streams.

To help reduce pressure variation at the point of application, pumps can be attached to the adhesive system between the melter and the applicators. These pumps conventionally take the form of single or multi-stream gear pumps having a common drive shaft to power the pumps. The gear pumps can be attached to a unitary manifold. These gear pumps function to further control the pressure of the adhesive in the applicator system. However, pumps utilizing common drive shafts have drawbacks.

For example, if an operator desires to change the motor speed of a dual-stream pump in a system utilizing a common drive shaft (referring to Remote Metering Devices), the operator will inherently change the flow output of both streams. This decreases flexibility regarding controlling individual flow streams.

Therefore, there is a need for a remote metering device that allows for individually controllable flow paths, and/or the ability to add additional pumps as needed without requiring additional melters.

SUMMARY

An embodiment of the present invention includes a remote metering station for pumping a flow of adhesive to a dispensing applicator. The remote metering station includes a manifold having a front surface, a back surface opposite to the front surface, a first side surface, and a second side surface opposite the first side surface. The remote metering station also includes a modular pump assembly removably mounted to the manifold, where the modular pump assembly includes a bottom surface, an outlet on the bottom surface, the outlet being in fluid communication with the manifold, and an inlet for receiving the adhesive. The modular pump assembly further includes a gear assembly and a drive motor coupled to the gear assembly. The gear assembly is operable for pumping the adhesive from the inlet to the outlet. Additionally, the drive motor has a shaft that has an axis that intersects the bottom surface, and the axis of the shaft does not intersect either of the first side surface or the second side surface.

Another embodiment of the present invention includes a remote metering station for pumping a flow of adhesive to a dispensing module. The remote metering station includes a manifold having a front surface, a back surface opposite to the front surface, a first side surface, a second side surface opposite the first side surface, a top surface, and a bottom surface opposite to said top surface, as well as a modular pump assembly removably mounted to the manifold. The modular pump assembly includes an inlet for receiving the adhesive, an outlet in fluid communication with the manifold, and a gear assembly. The modular pump assembly also includes a drive motor coupled to the gear assembly and operable for pumping adhesive from the inlet to the outlet, where the drive motor has a drive shaft connected to the gear assembly, and the drive shaft has an axis that intersects the front and back surfaces of said manifold and does not intersect any of the first side surface, the second side surface, or the bottom surface of the manifold.

The remote metering station of the above embodiments also includes a hose coupled to the manifold, where the hose is in fluid communication with the outlet. The remote metering station further includes a dispensing module coupled to the hose, where the dispensing module is spaced from the manifold.

BRIEF DESCRIPTION OF THE DRAWINGS

The foregoing summary, as well as the following detailed description, will be better understood when read in conjunction with the appended drawings. The drawings show illustrative embodiments of the invention. It should be understood, however, that the application is not limited to the precise arrangements and instrumentalities shown.

DETAILED DESCRIPTION OF ILLUSTRATIVE EMBODIMENTS

Figure 1:
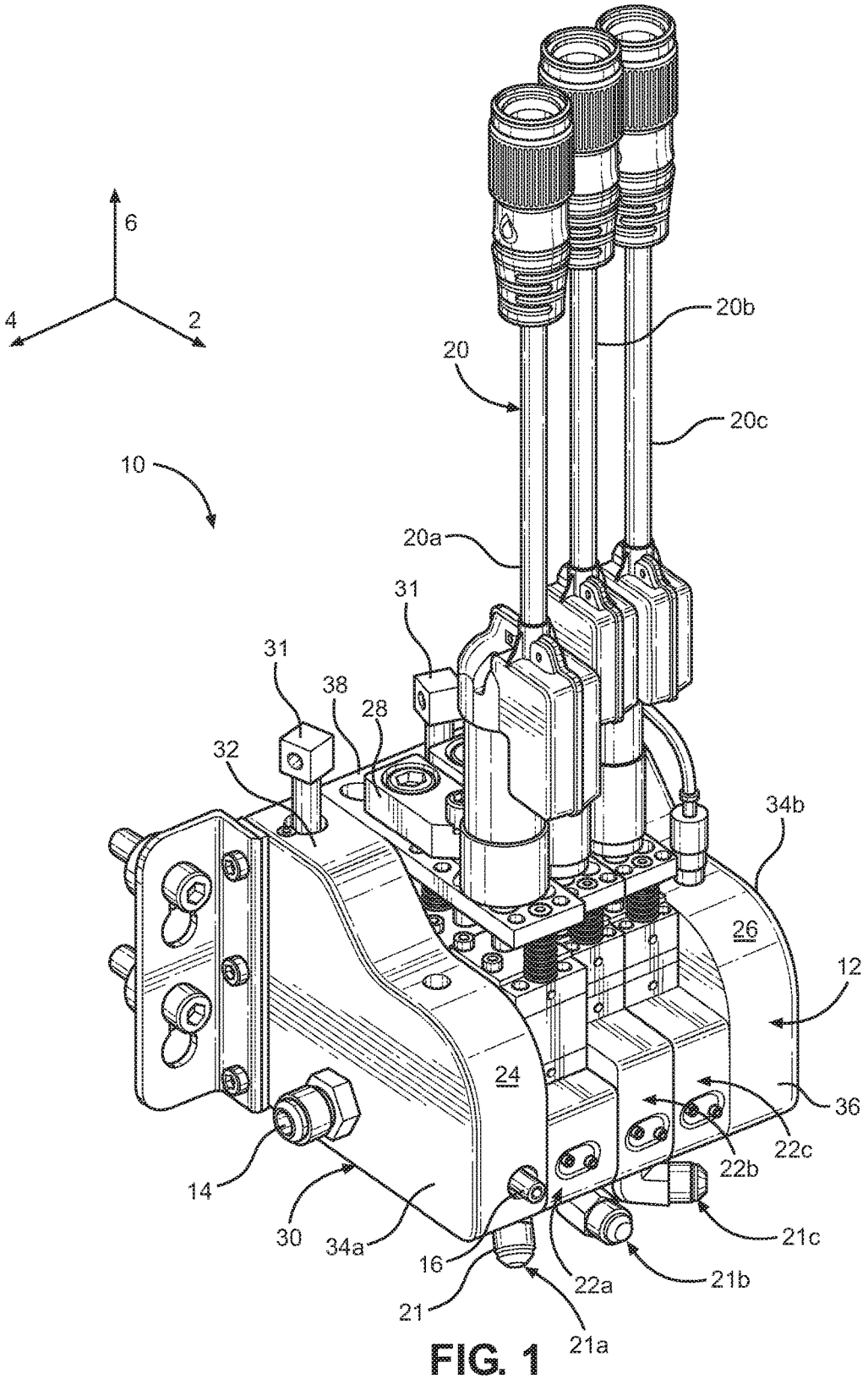
FIG. 1 is a front perspective view of a remote metering station according to an embodiment of the present invention.
Figure 2:
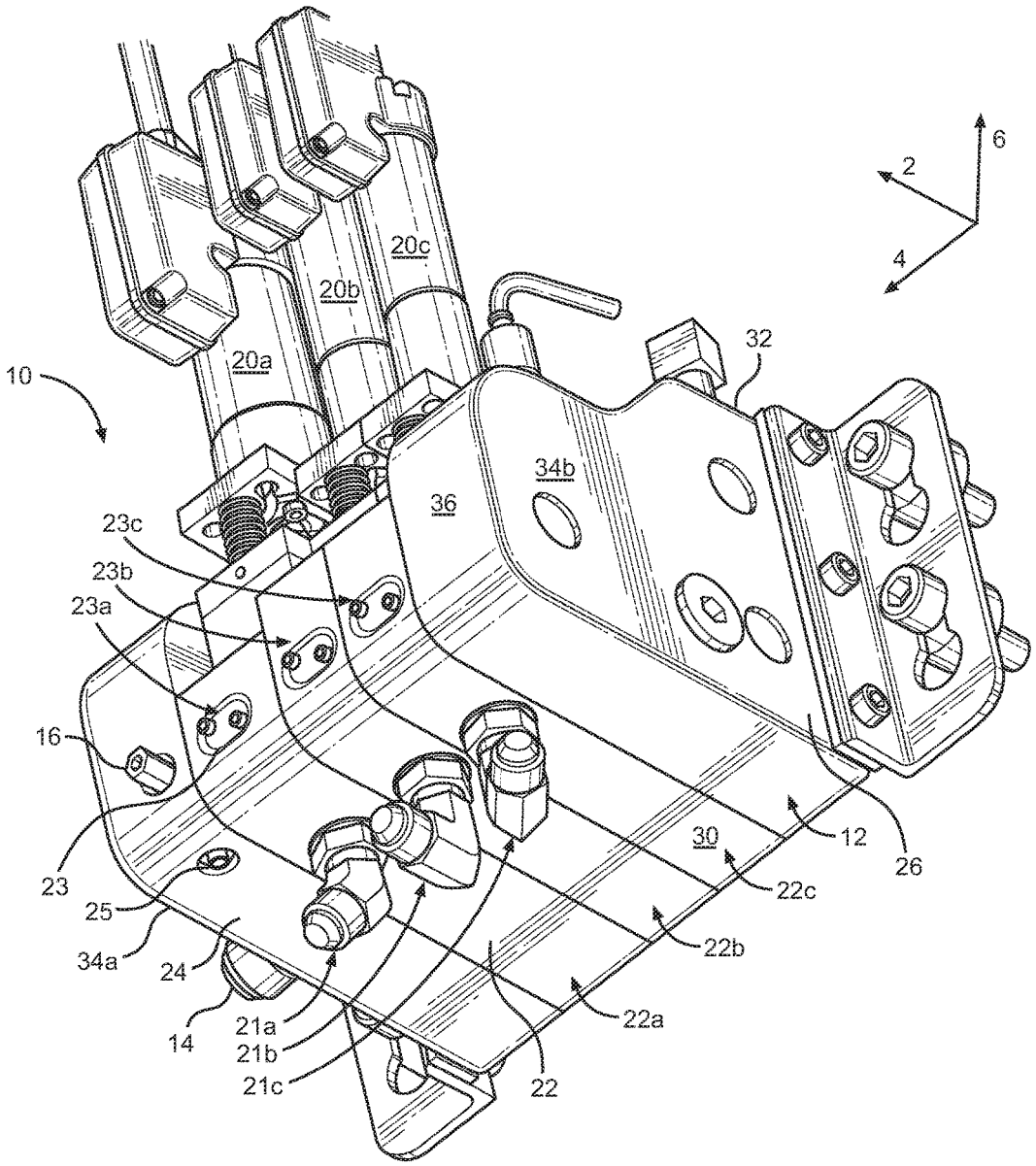
FIG. 2 is a bottom perspective view of the remote metering station shown in FIG. 1.

Described herein is a remote metering station 10 that has a manifold 12 and includes a modular pump assembly 20. Each of the modular pump assemblies includes an inlet 52 for receiving the adhesive and an outlet 54 in fluid communication with the manifold 12. Certain terminology is used to describe the remote metering station 10 in the following description for convenience only and is not limiting. The words "right," "left," "lower," and "upper" designate directions in the drawings to which reference is made. The words "inner" and "outer" refer to directions toward and away from, respectively, the geometric center of the description to describe the remote metering station 10 and related parts thereof. The words "forward" and "rearward" refer to directions in a longitudinal direction 2 and a direction opposite the longitudinal direction 2 along the remote metering station 10 and related parts thereof. The terminology includes the above-listed words, derivatives thereof, and words of similar import.

Unless otherwise specified herein, the terms "longitudinal," "transverse," and "lateral" are used to describe the orthogonal directional components of various components of the remote metering station 10, as designated by the longitudinal direction 2, lateral direction 4, and transverse direction 6. It should be appreciated that while the longitudinal and lateral directions 2 and 4 are illustrated as extending along a horizontal plane, and the transverse direction 6 is illustrated as extending along a vertical plane, the planes that encompass the various directions may differ during use.

Embodiments of the present invention include a remote metering station 10 for dispensing a hot-melt adhesive onto a substrate during, for example, the manufacture of personal disposable hygiene products, such as diapers. Referring to FIGS. 1-6, the remote metering station 10 includes a manifold 12. The manifold 12 has a top surface 32, a bottom surface 30 opposite the top surface 32 along the transverse direction 6, a first side surface 34*a*, a second side surface 34*b* opposite the first side surface 34*a* along the lateral direction 4, a front surface 36, and a back surface 38 opposite the front surface 36 along the longitudinal direction 2. The first and second side surfaces 34*a* and 34*b* extend from the front surface 36 to the back surface 38, as well as from the bottom surface 30 to the top surface 32. The manifold 12 includes an input connector 14, through which adhesive is pumped into the manifold 12, as will be discussed below. The manifold 12 further includes a pressure release valve 16 that allows a user to attenuate pressure created by adhesive within the manifold 12, and an output connector 21 that allows adhesive to be transported from the remote metering station 10 to dispensing modules 450 and 460 (see FIG. 17). When the pressure release valve 16 is opened, adhesive may drain from the manifold through a drain 25. The remote metering station 10 includes a modular pump assembly 20 removably mounted to the manifold 12. The manifold 12 further includes a manifold segment 22 coupled to the modular pump assembly 20, where the manifold segment 22 is disposed between two manifold end plates 24 and 26 that are spaced apart along the lateral direction 4. Each manifold segment 22 includes a pressure port plug 23 that covers and seals the opening of a pressure sensing channel 306 to measure adhesive output pressure of each pump 20 (discussed further below).

In various embodiments, the remote metering station 10 includes multiple sets of modular pump assemblies 20, output connectors 21, manifold segments 22, and pressure port plugs 23. As illustrated in FIGS. 1-6, for example, the remote metering station 10 is depicted as including three modular pump assemblies 20*a*, 20*b*, and 20*c*. Although FIGS. 1-6 illustrate three modular pump assemblies 20*a*-20*c*, the remote metering station 10 can include any number of modular pump assemblies 20 as desired. For example, the remote metering station 10 can include a single modular pump assembly, two modular pump assemblies, or more than two modular pump assemblies. Because this embodiment of the remote metering station 10 includes three pump assemblies 20*a*-20*c*, this embodiment of the remote metering station 10 also includes three output connectors 21 (21*a*, 21*b*, and 21*c*), three manifold segments 22 (22*a*, 22*b*, and 22*c*), and three pressure port plugs (23*a*, 23*b*, and 23*c*), which each correspond to a respective one of the modular pump assemblies 20*a*, 20*b*, and 20*c*. For clarity, a single modular pump assembly 20 is described below and reference number 20 can be used interchangeably with reference numbers 20*a*-20*c*. In the embodiment shown in FIGS. 1-6, each manifold segment 22 is coupled to and associated with one modular pump assembly 20, one output connector 21, and one pressure port plug 23. However, two or more modular pump assemblies 20, two or more output connectors 21, and two or more pressure port plugs 23 may be coupled to a single manifold segment 22.

Figure 3:
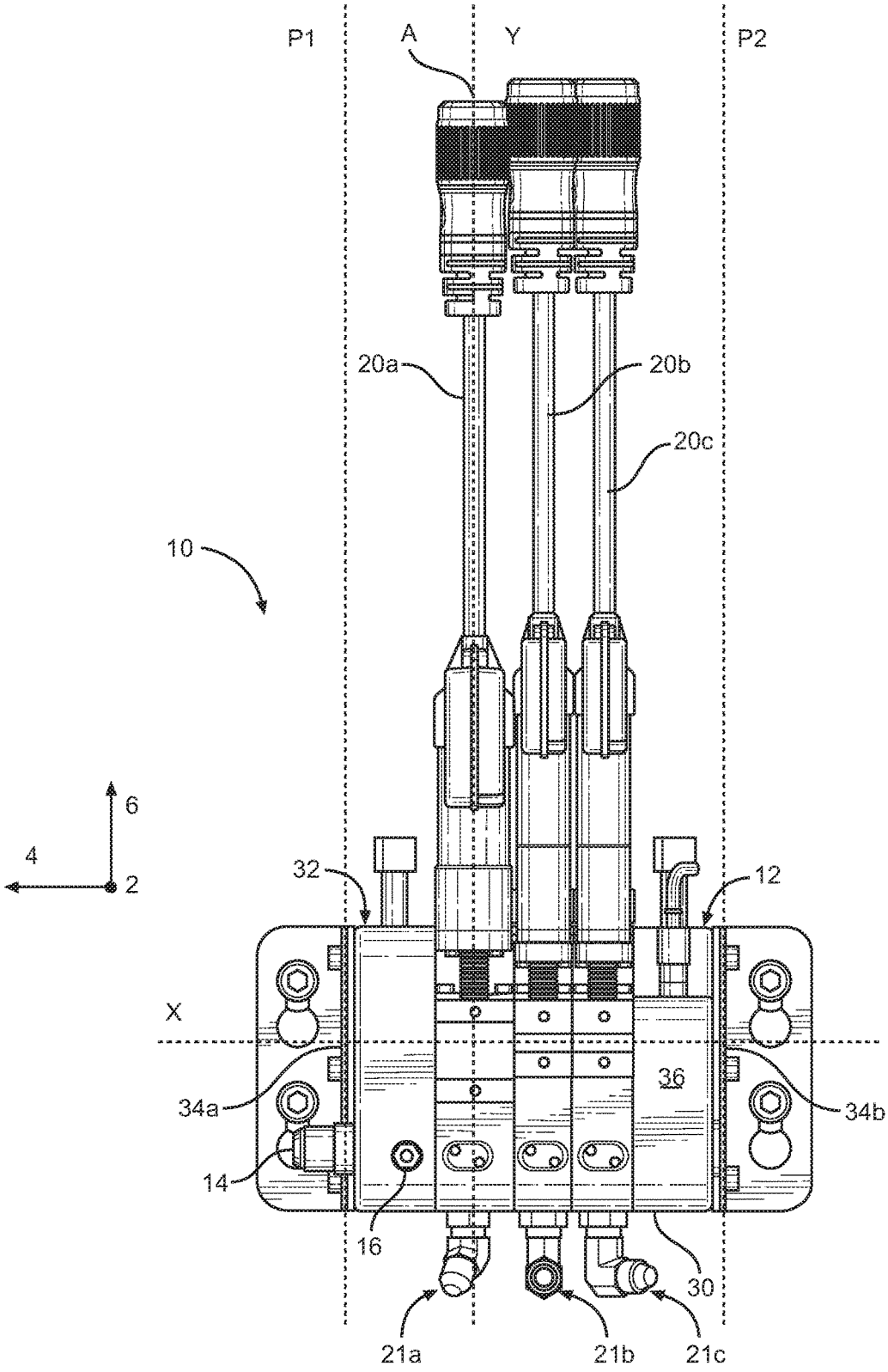
FIG. 3 is a front view of the remote metering station shown in FIG. 1.
Figure 4:
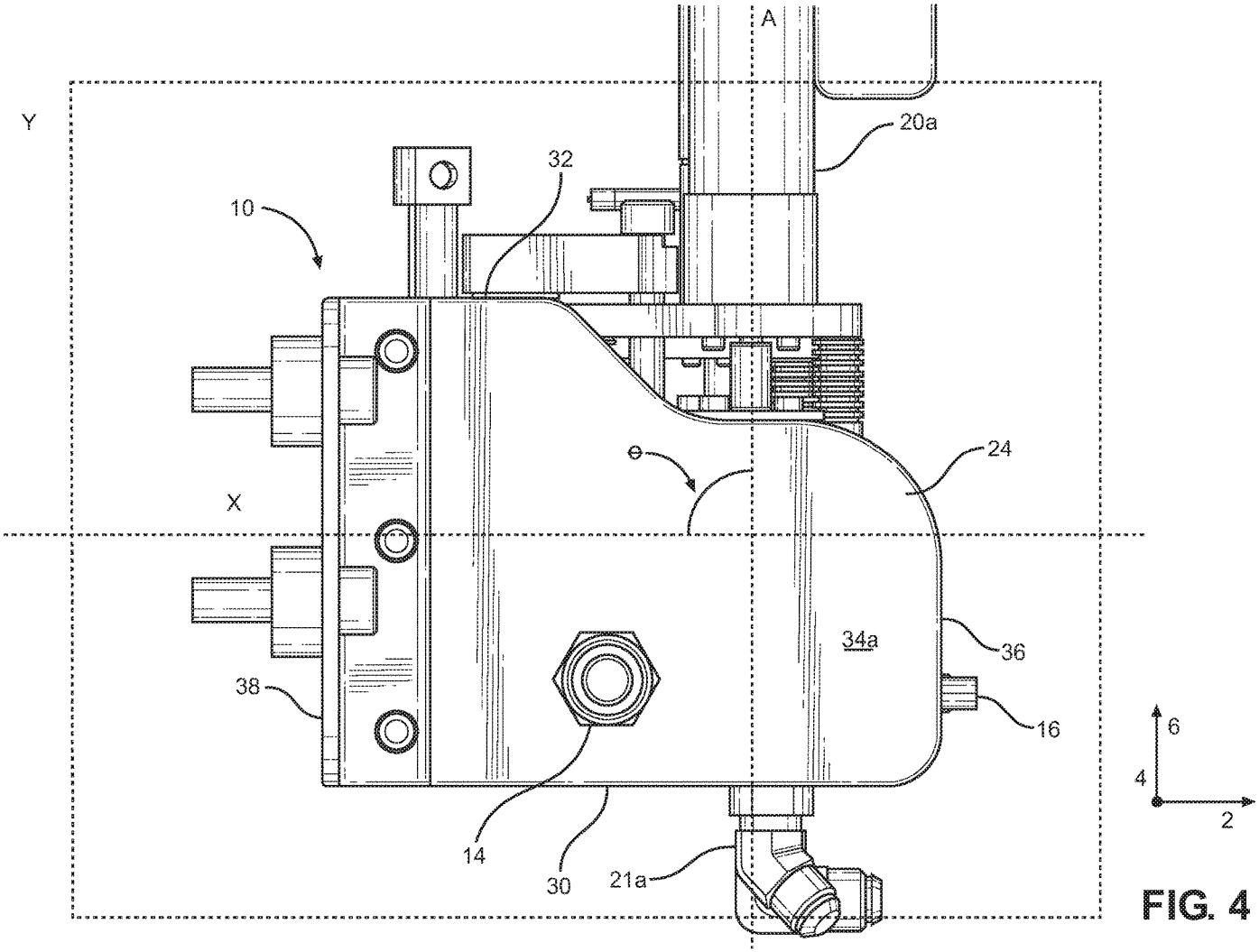
FIG. 4 is a side view of the remote metering station shown in FIG. 1.

Referring to FIGS. 3-4, the first side surface 34*a* of the manifold 12 lies within a first plane P1, while the second side surface 34*b* lies within a second plane P2. The second plane P2 may be parallel to the first plane P1. However, the first and second planes P1 and P2 may not be parallel if the first and second side surfaces 34*a* and 34*b* are angled with respect to each other. The remote metering station 10 defines a horizontal plane X, such that the lateral and longitudinal directions 4 and 2 lie within the horizontal plane X. The modular pump assembly 20 defines a drive shaft axis A that lies within a plane Y. The interrelationship of these planes and axes will be described further below.

Figure 7:
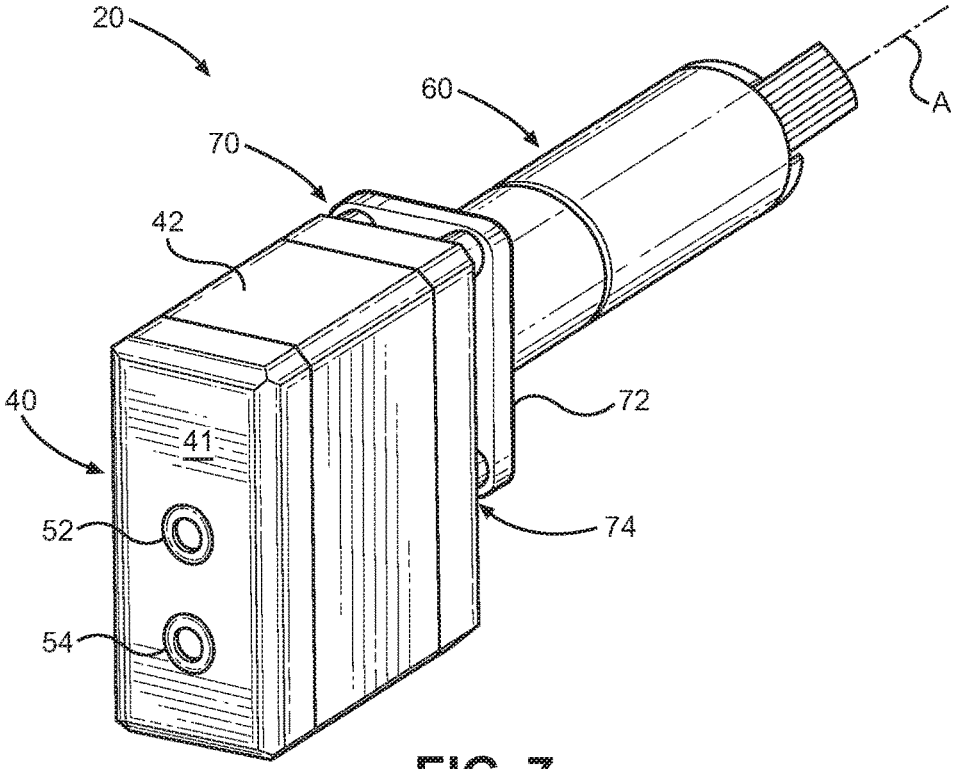
FIG. 7 is a bottom perspective view of a modular pump assembly used in the remote metering station shown in FIG. 1.
Figure 8:
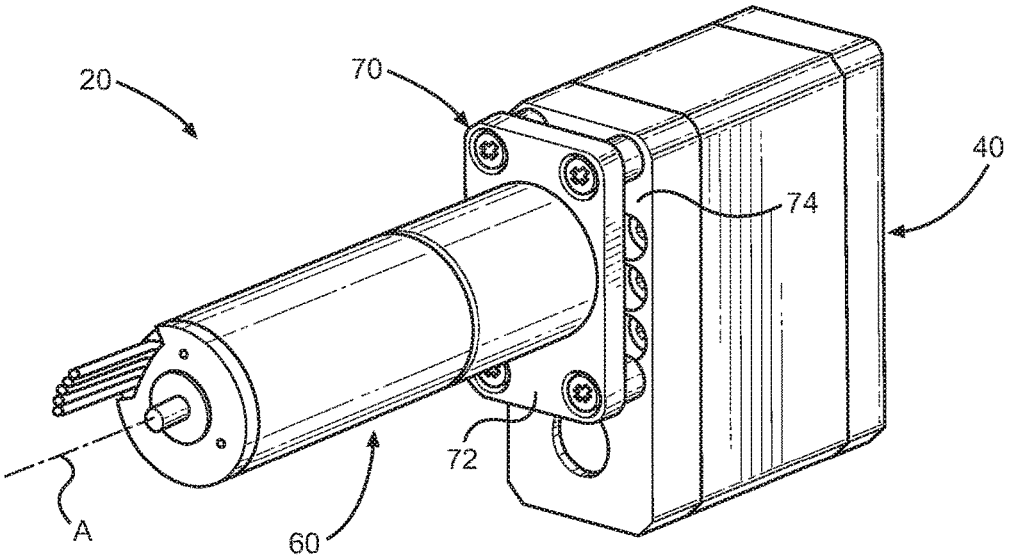
FIG. 8 is a top perspective view of the modular pump assembly shown in FIG. 7.
Figure 9:
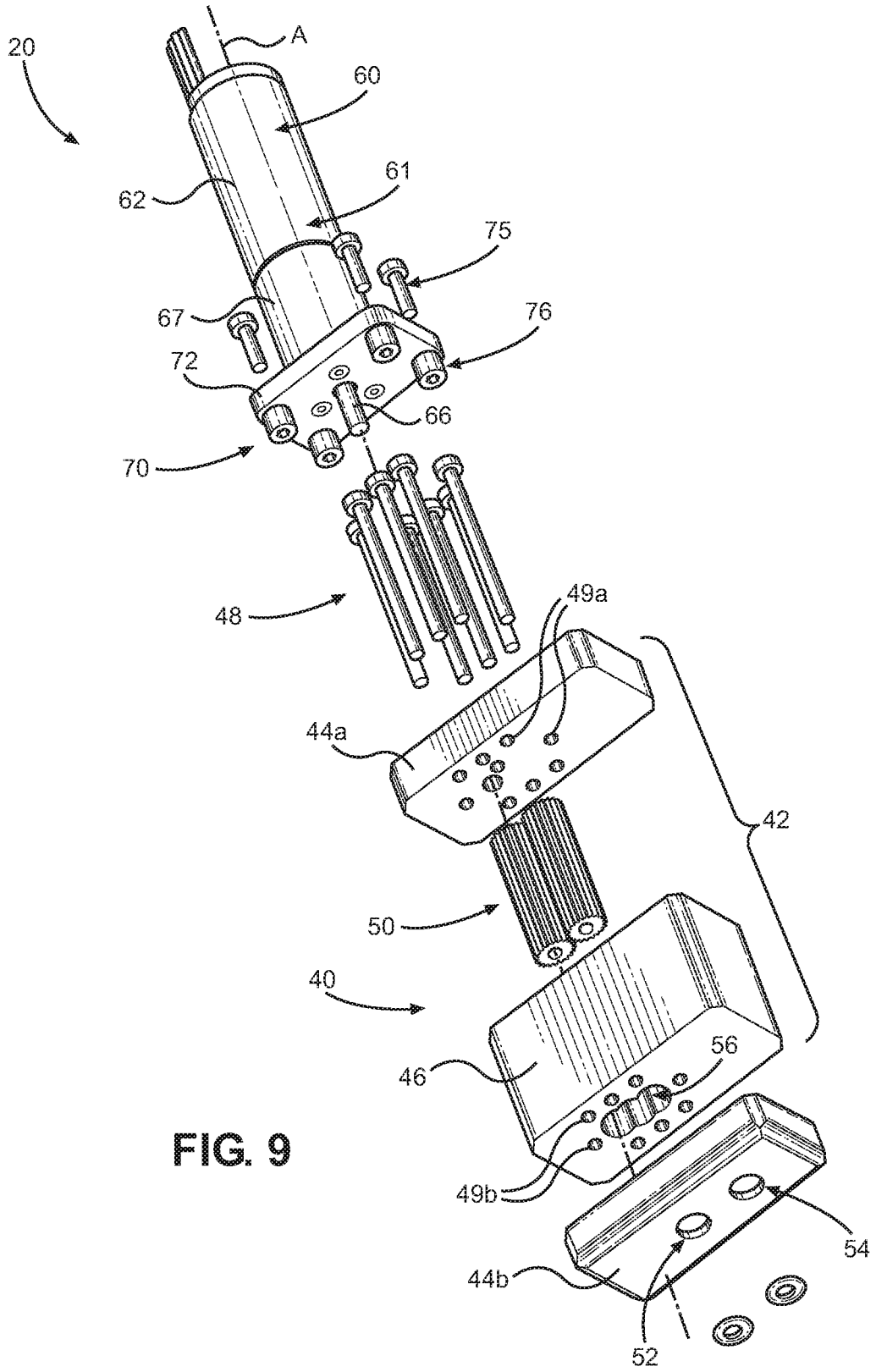
FIG. 9 is an exploded view of the modular pump assembly shown in FIG. 7.

Referring to FIGS. 7-9, the pump assembly 20 is configured to supply heated adhesive to the manifold 12 at a particular flow rate. Each modular pump assembly 20*a*-20*c* includes a pump 40 and a dedicated drive motor unit 60 that powers the pump 40. Because each pump 40 has a dedicated drive motor unit 60, each modular pump assembly 20 can be independently controlled by the operator and/or a control system 110 (shown in FIG. 12), as will be described further below. The modular pump assembly 20 also includes a thermal isolation region 70 positioned between the pump 40 and the drive motor unit 60. Thermal elements 31 may be used to elevate the temperature of the manifold 12, which, in turn, elevates the temperature of the pump 40 in each modular pump assembly 20. The thermal isolation region 70 minimizes thermal transfer from the pump 40 to the drive motor unit 60, thereby minimizing the effect of temperature on the electronic components in the drive motor unit 60. Exposing the electronic components in the drive motor unit 60 to a sufficiently elevated temperature may damage the electronic components, which may render the drive motor unit 60 inoperable.

The drive motor unit 60 includes a motor 62, an output drive shaft 66, and one or more connectors (not shown) that are coupled to a power source (not shown). The drive motor unit 60 is coupled to a control unit 150, which is included in the control system 110 shown in FIG. 12. The drive motor unit 60 additionally includes a rotational sensor 68 that is electronically coupled to the control unit 150, as well as a gear assembly 67. The gear assembly 67, which may include any type of gears as desired that transfer rotational motion from an output drive shaft 66 of the motor to the input drive shaft (not shown) of the pump to attain the desired rotational speed. In one embodiment, the gear assembly 67 includes a planetary gear train. The output drive shaft 66 has a drive axis A about which the drive shaft 66 rotates.

Referring back to FIGS. 3 and 4, the modular pump assembly 20 may be mounted to the manifold 12 in a number of different configurations. In one embodiment, the modular pump assembly 20 is mounted to the manifold 12 so that the bottom surface 41 of the pump 40, which includes an inlet 52 and an outlet 54, faces the manifold 12 at a location that is spaced apart from and located between the first and second side surfaces 34*a* and 34*b*. In this configuration, the drive motor axis A does not intersect either the first side surface 34*a* or the second side surface 34*b* of the remote metering station 10. Rather, the modular pump assembly 20 is positioned on the manifold 12 such that the drive motor axis A of the drive motor unit 60 lies in a plane Y that is parallel to the first plane P1, in which the first side surface 34*a* lies, as described above. The plane Y may also be parallel to the second plane P2, in which the second side surface 34*b* lies. Each modular pump assembly 20*a*-20*c* has a respective axis A that lies within a respective plane that may be parallel to the first plane P1 and/or the second plane P2.

Continuing with FIGS. 3 and 4, the modular pump assembly 20 is positioned on the manifold 12 such that the drive motor axis A is oriented in any particular direction within plane Y. For example, the pump assembly 20 can be positioned on the manifold 12 such that the drive motor axis A lies within plane Y and is angularly offset with respect to plane X. For instance, the modular pump assembly 20 can be positioned on the manifold 12 such that the drive motor axis A defines an angle θ with plane X. The angle θ can be any angle as desired. In one embodiment, the angle θ is 90 degrees. Alternatively, the angle θ can be an acute angle, an obtuse angle, or an angle greater than 180 degrees.

Referring to FIGS. 7-11, the pump 40 includes a housing assembly 42 and a gear assembly 50 contained within the housing assembly 42. Alternatively, more than one gear assembly 50 may be contained within the housing assembly 42. The housing assembly 42 further includes an inlet 52 that is configured to receive liquid from the manifold segment 22, as well as an outlet 54 for discharging liquid back into the manifold assembly 22. In accordance with the embodiment illustrated in FIGS. 7-9, the inlet 52 and the outlet 54 of the pump 40 are oriented in a direction that is parallel to the drive motor axis A of the drive motor unit 60.

The housing assembly 42 comprises an upper plate 44*a*, a lower plate 44*b*, and a central block 46. The upper and lower plates 44*a* and 44*b* are spaced from each other along a direction that is aligned with a drive axis A of the drive motor unit 60. The upper plate 44*a* defines a bottom surface 41, through which the drive axis A may extend. The upper plate 44*a*, the central block 46, and the lower plate 44*b* are coupled together with bolts 48. The upper plate 44*a* has a plurality of bores 49*a* that are configured to receive the bolts 48, the central block 46 has a plurality of bores 49*b* that are configured to receive the bolts 48, and the lower plate 44*b* has a plurality of bores (not shown) that are configured to receive the bolts 48. The bolts 48, bores 49*a*, and bores 49*b* are threaded, such that the bores 49*a* and 49*b* are capable of threadedly receiving the bolts 48.

Figure 10:
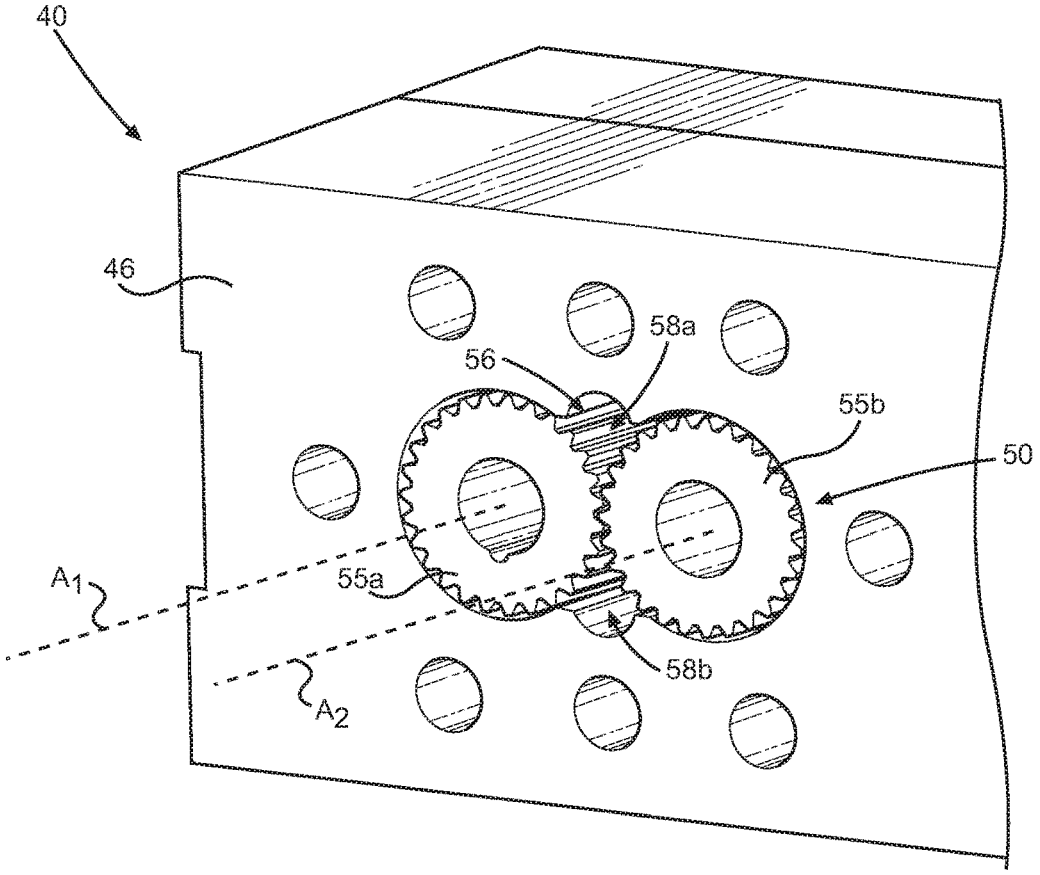
FIG. 10 is a sectional view of the modular pump assembly shown in FIG. 7.
Figure 11:
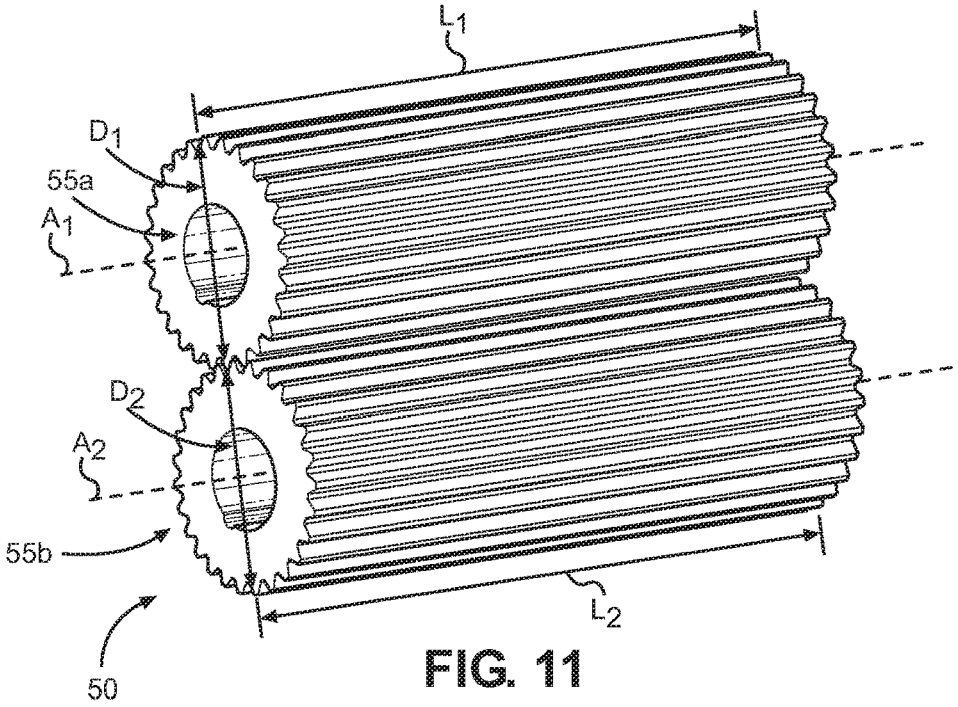
FIG. 11 is a perspective view of a gear assembly used in the modular pump assembly shown in FIGS. 7-10.

The central block 46 has an internal chamber 56 that is sized to generally conform to the profile of the gear assembly 50. In one embodiment, the gear assembly 50 includes a driven gear 55*a* and an idler gear 55*b*, which are known to a person of ordinary skill in the art. The driven gear 55*a* is coupled to the output drive shaft 66 of the drive motor unit 60 such that rotation of the drive shaft 66 rotates the driven gear 55*a*, which, in turn, rotates the idler gear 55*b*. The driven gear 55*a* rotates about a first axis $A_1$, while the idler gear 55*b* rotates about a second axis A2. In FIG. 10, the first axis $A_1$ is illustrated as coaxial with the drive motor axis A. However, it is also contemplated that the first axis $A_1$ may be offset from the drive motor axis A. The gear assembly 50 may include an elongate gear shaft (not shown) that is coupled to an end of the output drive shaft 66 via a coupling (not shown). The gear shaft extends into the driven gear 55*a*, and is keyed to actuate the driven gear 55*a*. A seal member (not shown), such as a coating and/or an encasement, can be placed around the elongate gear shaft to facilitate sealing the gear assembly 50.

In use, rotation of the driven gear 55*a* and the idler gear 55*b* drives adhesive in the pump 40 from a first section 58*a* of the chamber 56 to a second section 58*b* of the chamber 56. The adhesive is then routed from the second section 58*b* of the chamber 56 to the outlet 54. In accordance with the illustrated embodiment, the driven gear 55*a* has a diameter $D_1$ and a length $L_1$ that is (typically) greater than the diameter $D_1$. Likewise, the idler gear 55*b* has a diameter $D_2$ and a length $L_2$ that is (typically) greater than the diameter $D_2$. While a gear assembly 50 with two gears is shown, the pump can have a gear assembly that has any number of gear configurations to produce the desired flow rate of adhesive through the pump 40. In these configurations, the central block 46 can be segmented to support gear stacking. In one embodiment, a plurality of gear assemblies (not shown) can be stacked along the pump input shaft. In this embodiment, the gear assemblies can have different outputs that are combined into a single output stream. In another embodiment, the gear assemblies have different outputs that can be kept separate to provide multiple outputs through additional porting in the lower plate 44*b* and the manifold 12.

Continuing with FIGS. 7-11, the thermal isolation region 70 is defined by a thermal isolation plate 72 and a gap 74 that extends from the thermal isolation plate 72 to the housing assembly 42. The pump assembly 20 includes bolts 75 that couple the thermal isolation plate 72 to the top of the housing assembly 42 so that the gap 74 is formed between the housing assembly 42 and the thermal isolation plate 72. The thermal isolation plate 72 can include a plurality of spacers 76 that are disposed around the bolts 75 and are positioned between a surface of the thermal isolation plate 72 and the upper plate 44*a* of the housing assembly 42. The spacers 76 may be monolithic with the thermal isolation plate 72, or may be separable from the thermal isolation plate 72 such that the gap 74 may be adjustable. The thermal isolation plate 72 functions to inhibit the transfer of heat from the pump 40 to the drive motor unit 60. To do this, the thermal isolation plate 72 and the spacers 76 are made of a material that has a lower thermal conductivity than the materials that form the components of the housing assembly 42 and an outer casing 61 of the drive motor unit 60. Furthermore, the spacers 76 separate the thermal isolation plate 72 and the housing assembly 42 such that the thermal isolation plate 72 and the housing assembly 42 has the gap 74, which minimizes direct contact between the housing assembly 42 and the drive motor unit 60.

Figure 5:
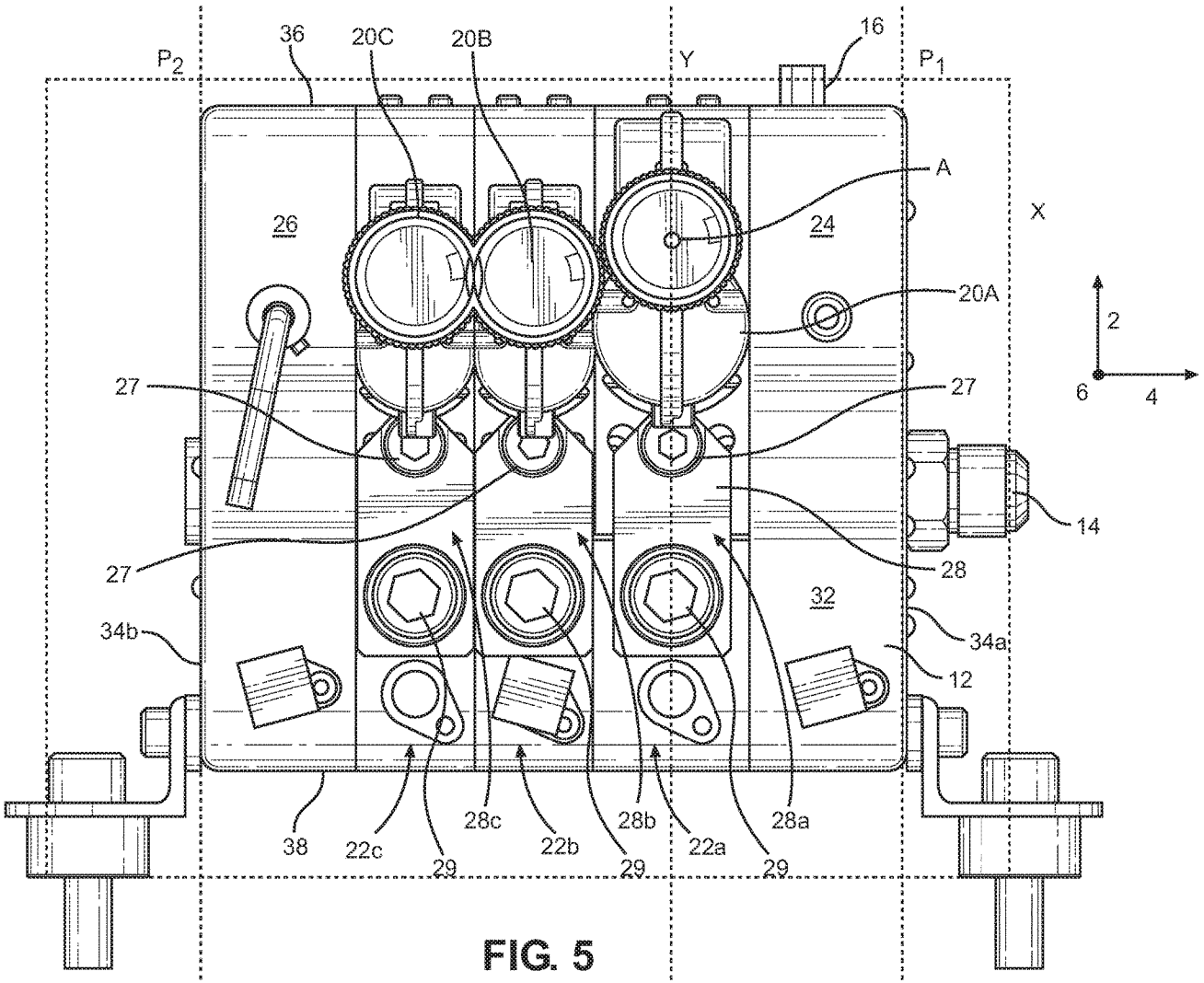
FIG. 5 is a top view of the remote metering station shown in FIG. 1.
Figure 6:
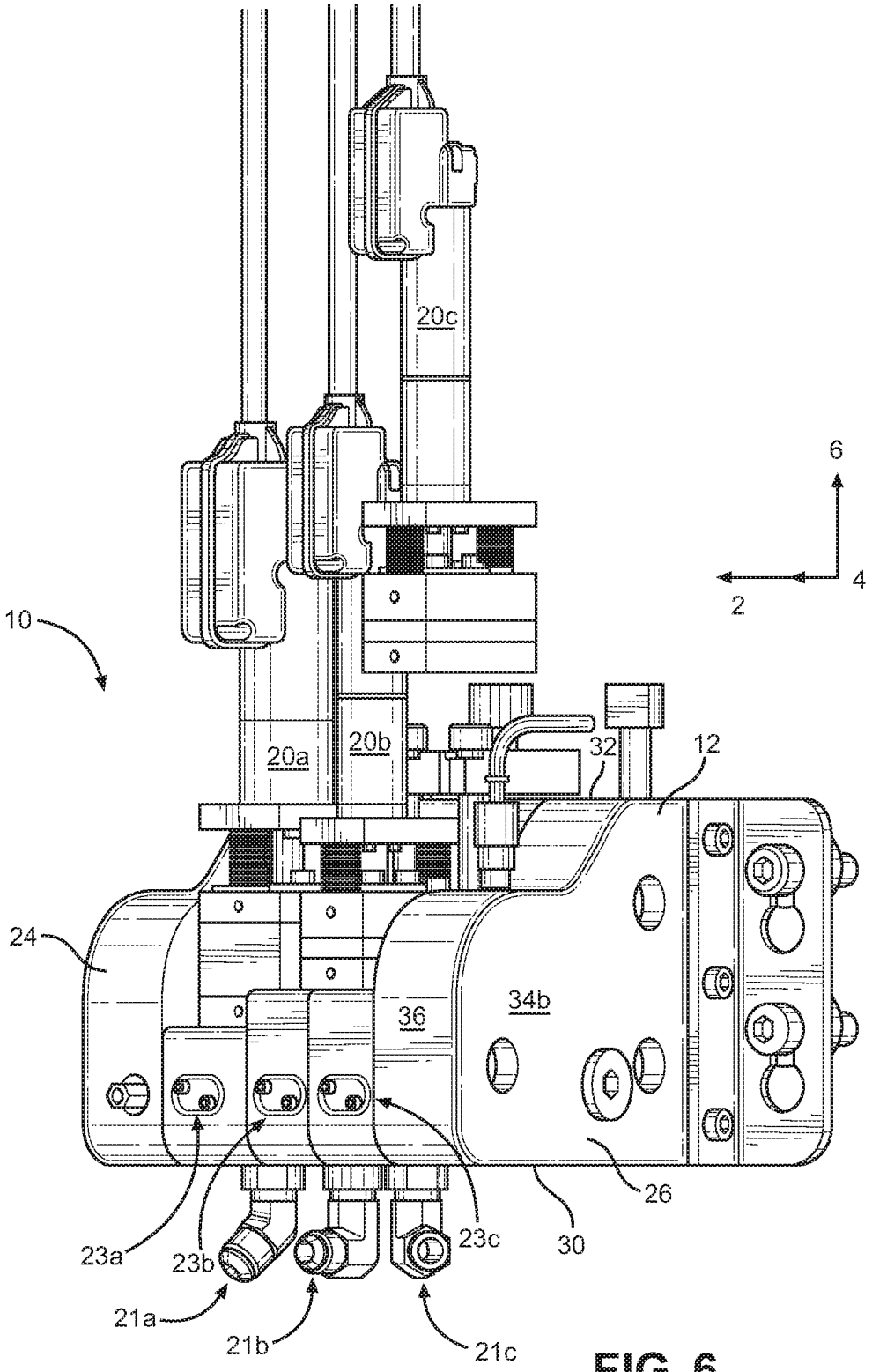
FIG. 6 is a front perspective view of the remote metering station shown in FIG. 1, with a modular pump assembly removed from the remote metering station.

Referring to FIGS. 4 and 5, the modular pump assemblies 20*a*-20*c* are removably coupled to the manifold 12, such that the modular pump assemblies 20*a*-20*c* may be removed from the remote metering station 10 and replaced with other modular pump assemblies as desired. The modular pump assemblies 20*a*-20*c* are secured to the manifold 12 by respective plates 28. For example, a plate 28*a* secures the modular pump assembly 20*a* to the manifold segment 22*a*, a plate 28*b* secures the modular pump assembly 20*b* to the manifold segment 22*b*, and a plate 28*c* secures the modular pump assembly 20*c* to the manifold segment 22*c*. Fasteners 27 secure a portion of each of the plates 28*a*-28*c* to the respective one of the modular pump assemblies 20*a*-20*c*, and fasteners 29 secure another portion of each of the plates 28*a*-28*c* to the respective manifold segments 22*a*-22*c*. In order to remove and/or replace any of the modular pump assemblies 20*a*-20*c*, an operator of the remote metering station 10 can loosen the fastener 27 from the plate 28 corresponding to the modular pump assembly 20 that is being removed. Additionally, the operator can loosen the fastener 29 from the plate 28 corresponding to the manifold segments 22*a*-22*c* that is being removed to separate the plate 28 from the remote metering station 10. Those features reduce the time and effort required to remove and/or replace any of the modular pump assemblies 20*a*-20*c* from the remote metering station 10.

Figure 12:
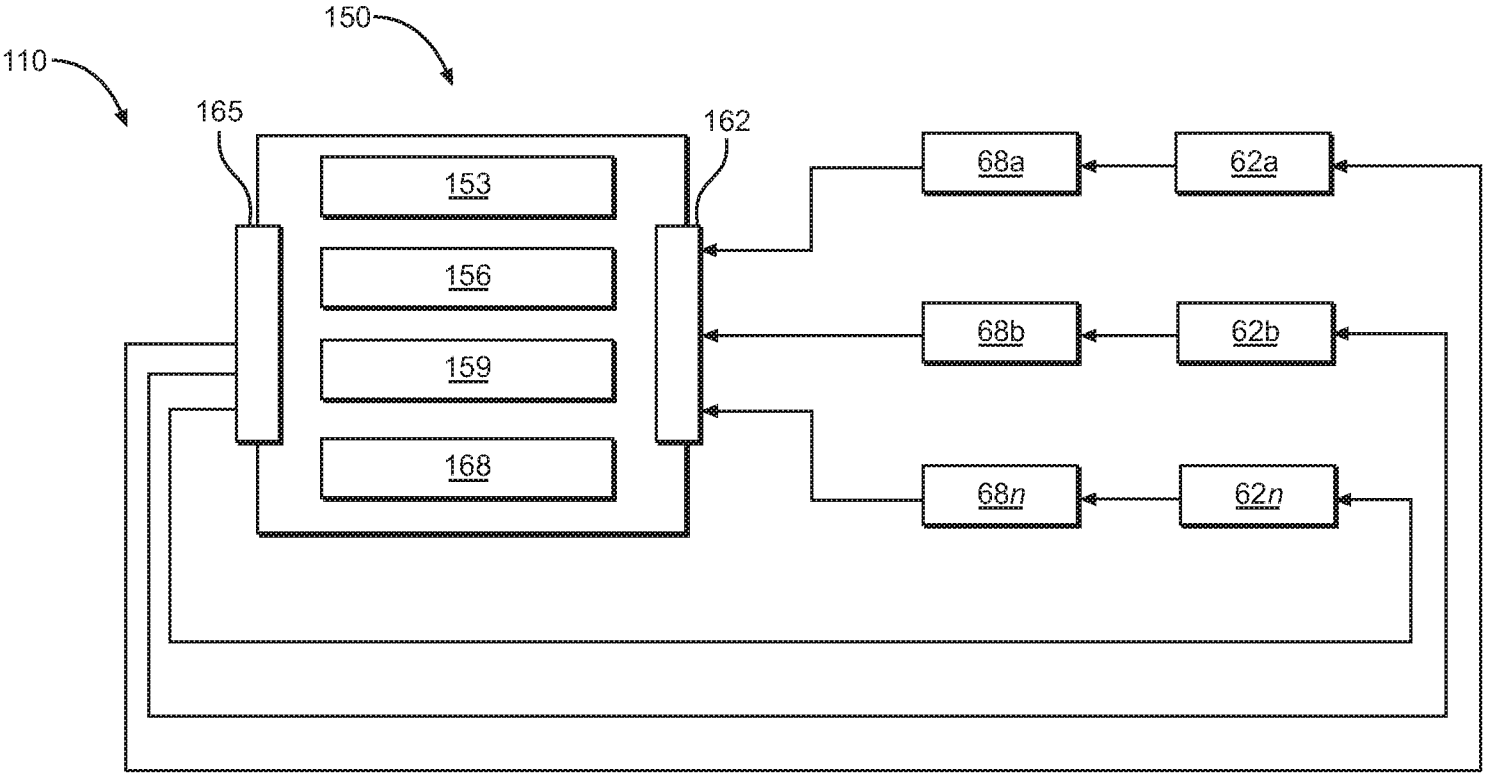
FIG. 12 is a schematic block diagram of a control system that controls operation of the drive motor units in the modular pump assemblies of the remote metering station shown in FIGS. 1-11.

FIG. 12 depicts a schematic block diagram of a control system 110 configured as a closed feedback loop for controlling aspects of the operation of the modular pump assembly 20. As can be seen in FIG. 12, the control system 110 includes a control unit 150, which is a logic unit. In the embodiment where multiple modular pump assemblies 20*a*, 20*b* . . . 20*n* are used, as illustrated in FIG. 12, the control unit 150 is electronically coupled to rotational sensors 68*a*, 68*b* . . . 68*n*. Each rotational sensor 68*a*, 68*b* . . . 68*n* is coupled to a respective motor 62*a*, 62*b* . . . 62*n*. The rotational sensors 68*a*, 68*b* . . . 68*n* include rotational encoders, Hall Effect sensors, and/or any other device that can measure rotation. Furthermore, the control unit 150 is also electronically coupled to each motor 62*a*, 62*b* . . . 62*n*. The control unit 150 includes one or more memories 156, one or more processors 153 used to execute instructions stored in the one or more memories 156, and input and output portions 162 and 165. The input and output portions 162 and 165 are typical transmit/receive devices that can transmit to and/or receive signals from other components of the control system 110. The control unit 150 further includes a transmitter 159 that is used to transmit information about the remote metering station 10 to an external system, such as a tablet, computer, or mobile device, as well as receive information or instructions transmitted by a user at a remote location. The control unit 150 may additionally include a user interface 168. The user interface may take the form of a keyboard, mouse, touch screen, or other physical interface, and can be utilized by a user to manually input instructions or other information into the control system 110.

The control system 110 operates as a closed loop feedback to maintain pump speeds within a targeted operating range. The control unit 150 has a target drive motor rotational speed (or "target RPM") set by the operator and stored in the memory 156. The rotational sensors 68*a*, 68*b* . . . 68*n* determine the actual rotational speed of the motors 62*a*, 62*b* . . . 62*n* (or the "actual RPM"), which is transmitted from the rotational sensors 68*a*, 68*b* . . . 68*n* to the control unit 150. Software executed by the processor 153 of the control unit 150 determines 1) if the actual RPM is different from the target RPM, and 2) the magnitude of variance (+/−) between the actual RPM and the target RPM, if any is detected. If the control unit 150 determines that a variance exists between the target RPM and the actual RPM, the control unit 150 transmits a signal to the particular one of the motors 62*a*, 62*b* . . . 62*n* where the actual RPM does not match the target RPM. This signal instructs the one of the motors 62*a*, 62*b* . . . 62*n* to either increase or decrease the rotational speed until the actual RPM is consistent with the target RPM (within reasonable processing limits typical in metered applications). This feedback loop may be applied across each modular pump assembly 20 installed on the remote metering station 10. In this way, the control system 110 functions to maintain the target rotational speed of each motor 62, which in turn, maintains a consistent volumetric flow rate over time. This limits processing drift that may occur gradually over time in conventional systems. Because each pump assembly is independently driven, the feedback loops for each particular pump assembly help control individual pump outputs.

Figure 13:
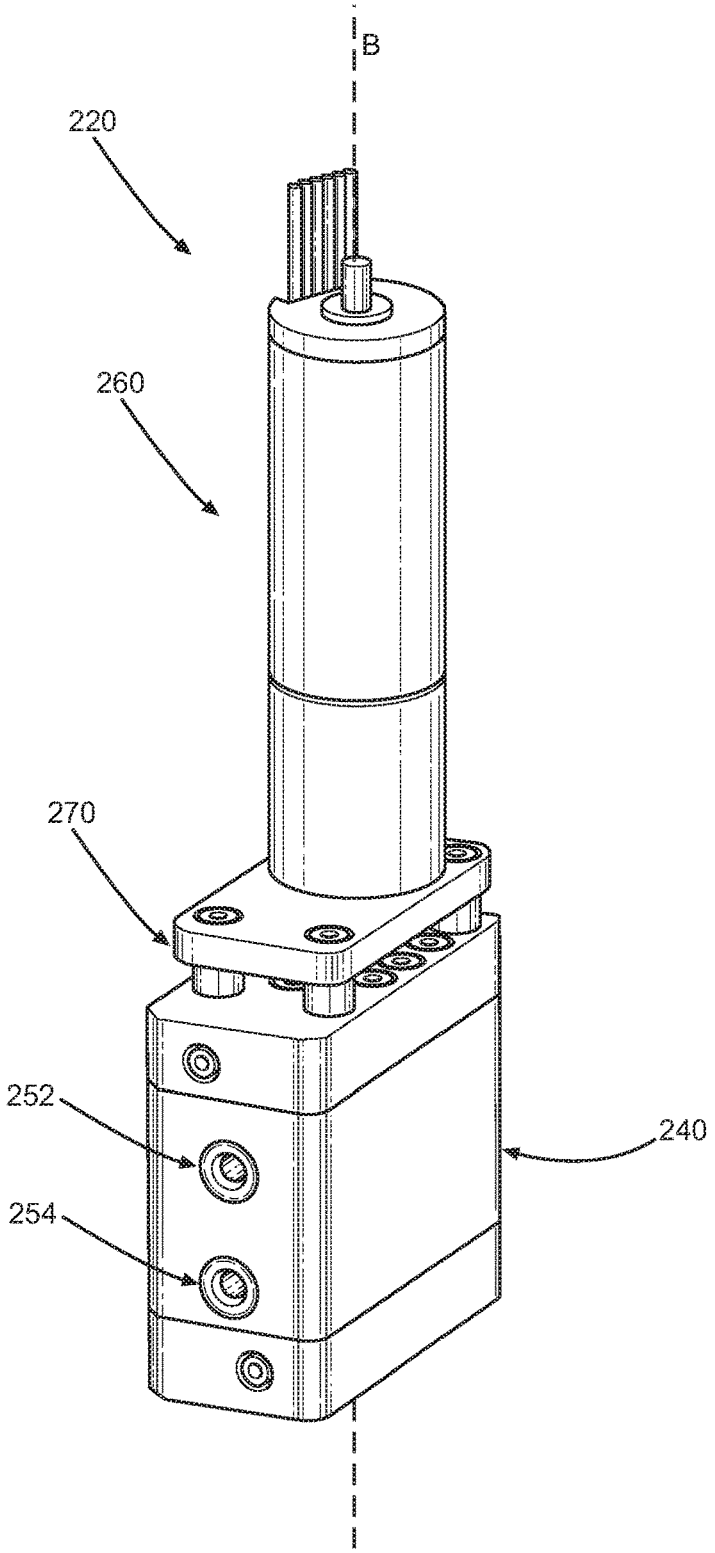
FIG. 13 is a perspective view of an alternate pump assembly that can be used in the remote metering station shown in FIG. 1.
Figure 14:
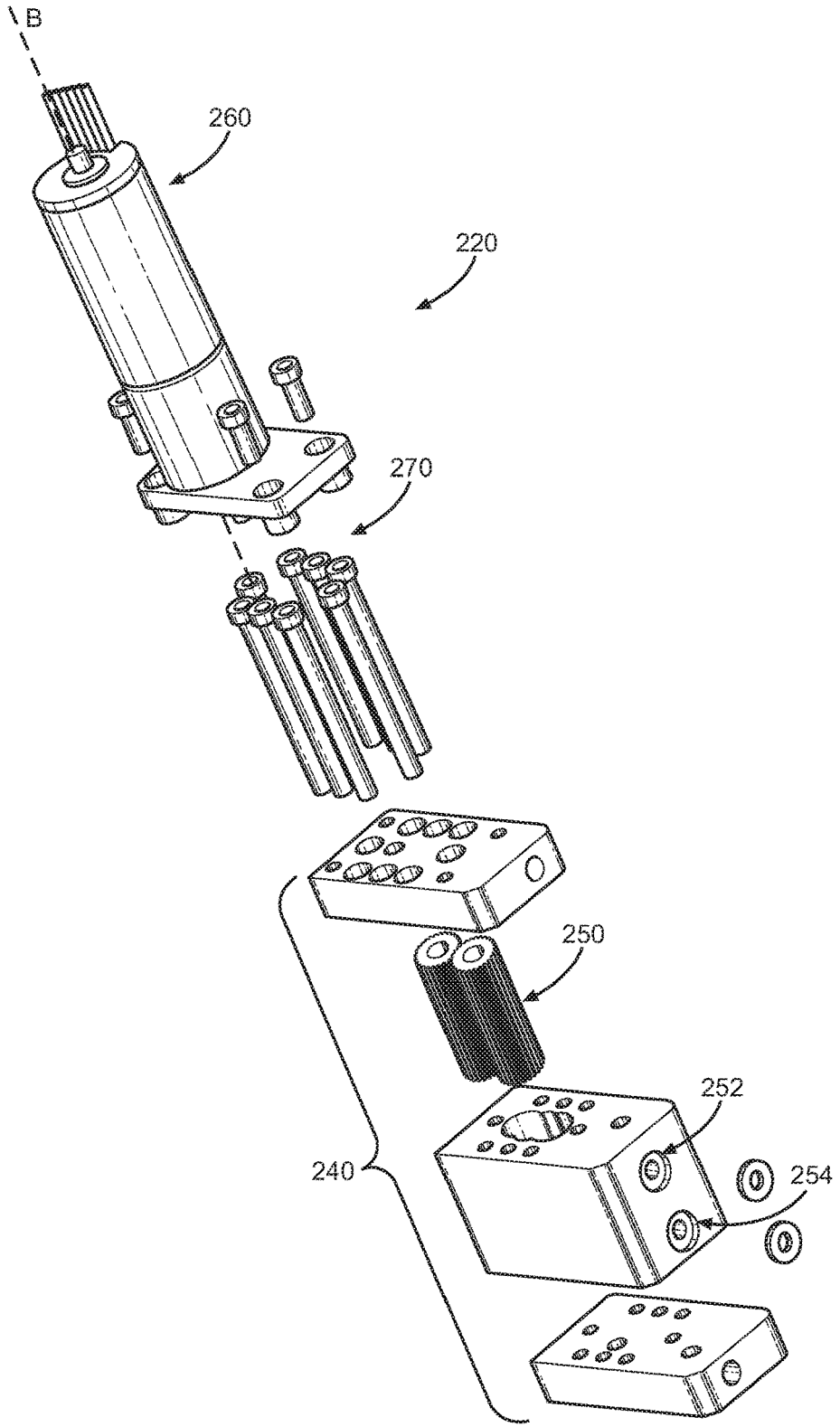
FIG. 14 is an exploded view of the pump assembly shown in FIG. 13.

FIGS. 13-14 illustrate another embodiment of the present invention. FIG. 13 shows a modular pump assembly 220 that is similar in most aspects to the modular pump assembly 20 shown in FIGS. 1-11 and described above. However, the modular pump assembly 220 has an inlet 252 and an outlet 254 that are oriented differently than the inlet 52 and outlet 54 of the modular pump assembly 20. The pump assembly 220 is configured to supply heated liquid to the manifold 12 at a given volumetric flow (or flow rate). Each pump assembly 220 includes a pump 240 and a dedicated drive motor unit 260 that powers the pump 240. The pump assembly 220 also includes a thermal isolation region 270 between the pump 240 and the drive motor unit 260. The thermal isolation region 270 minimizes thermal transfer of heat generated by the pump 240 to the drive motor unit 260, thereby minimizing the effect of temperature on the electronic components in the drive motor unit 260. The dedicated drive motor unit 260 and thermal isolation region 270 are the same as the drive motor unit 60 and the thermal isolation region 70 described above and illustrated in FIGS. 7-11.

Continuing with FIGS. 13-14, the drive motor unit 260 includes a motor 62, an output drive shaft 266, and connectors (not shown) that are coupled to a power source (not shown), as well as the control system 110. The drive shaft 266 has a drive axis B about which the drive shaft 266 rotates. When the pump assembly 220 is coupled to the manifold 12, the drive axis B may intersect and may be angularly offset with respect to the plane X that is perpendicular to the plane Y. In this configuration, the drive motor axis B does not intersect either the first side surface 34*a* or the second side surface 34*b* of the manifold 12. Additionally, the drive motor axis B does not intersect the bottom surface 30 of the manifold 12. Rather, the modular pump assembly 220 is positioned on the manifold 12 so that drive motor axis B of the drive motor unit 260 lies in a plane Y that is parallel to the first plane P1 and/or the second plane P2 of the first side surface 34*a* and the second side surface 34*b*, respectively. Also, the drive motor axis B intersects the front and back surfaces 36 and 38 of the manifold 12.

The pump 240 includes a housing assembly 242 and one or more gear assemblies 250 contained within the housing assembly 242, an inlet 252 for receiving liquid from the manifold segment 22, and an outlet 254 for discharging liquid back into the manifold segment 22. In accordance with the illustrated embodiment, the inlet 252 and the outlet 254 of the pump 240 are oriented in a direction that is perpendicular to the drive motor axis B of the drive motor unit 260.

Now referring to FIGS. 15-17, the flow path of adhesive through the manifold 12 and the pump assemblies 20*a*-20*c* will be described. The flow of adhesive through any particular element is represented by solid arrows that appear in the associated figures. The remote metering station 10 is attached to a melter 400 by a hose 420 (FIG. 17), which attaches to the input connector 14 of the remote metering station 10. The melter 400 can be any variety of melter that is suitable for hot-melt adhesive applications. Adhesive provided by the melter 400 flows through the hose 420, through the input connector 14, and into a main input channel 300 defined by the manifold 12 of the remote metering station 10. The main input channel 300 is depicted as extending from the first side surface 34*a* to the second side surface 34*b*, where an opening to the main input channel 300 at the second side surface 34*b* is blocked by a secondary input plug 320. However, the main input channel 300 may not necessarily extend entirely from the first side surface 34*a* to the second side surface 34*b*, but may terminate at an interior location between the first and second side surfaces 34*a* and 34*b*. Additionally, the main input channel 300 may extend between other combinations of surfaces of the manifold 12 as desired.

Figure 15:
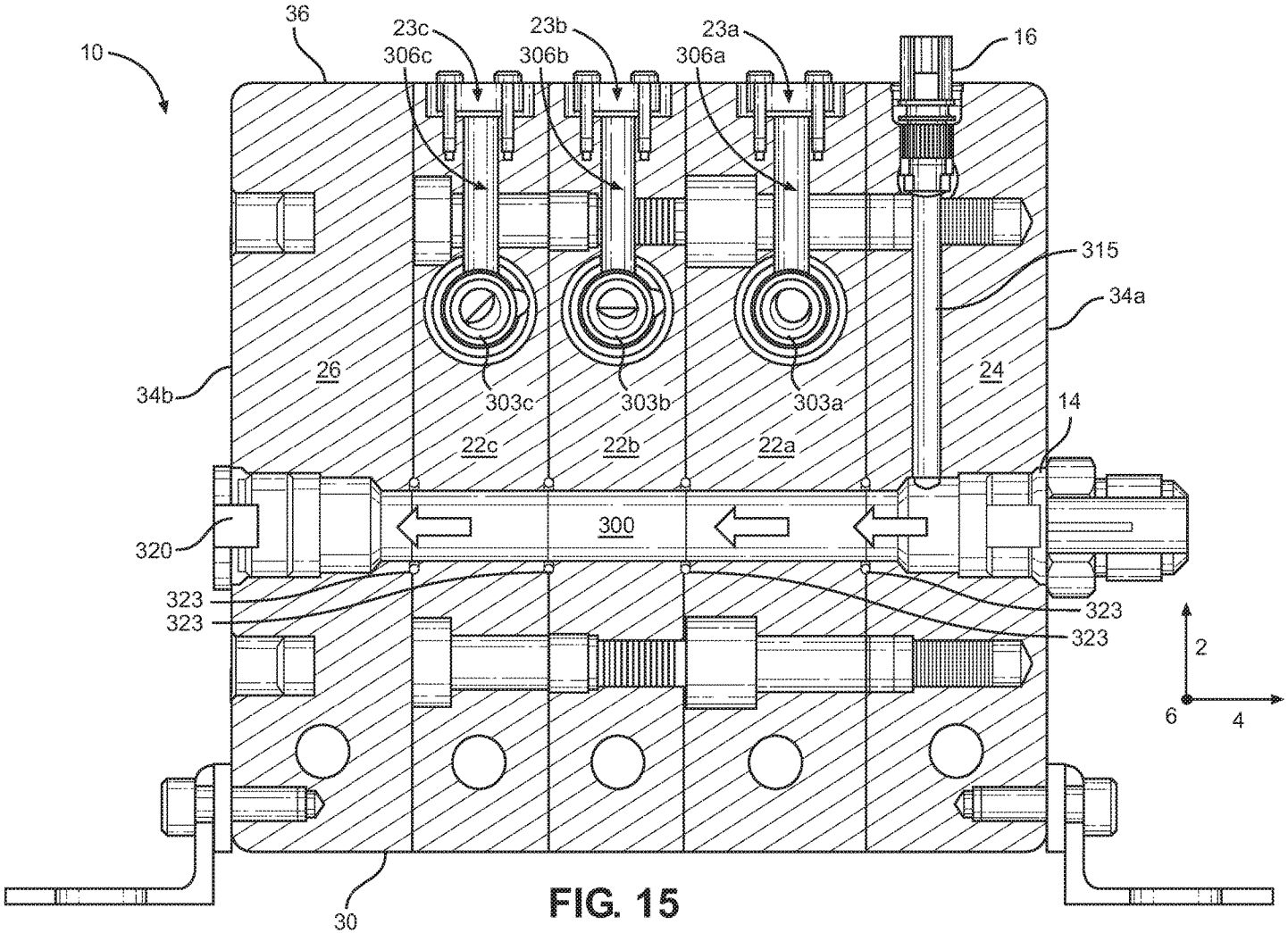
FIG. 15 is a horizontal sectional view of the remote metering station shown in FIG. 1.

Continuing with FIG. 15, the manifold 12 includes a pressure release channel 315 that extends from the main input channel 300 to the front surface 36. The pressure release valve 16 is positioned at the front surface 36 at the opening of the pressure release channel 315, and can be opened or closed as desired by an operator. Opening the pressure release valve 16 allows the operator to release adhesive from the main input channel 300 to safely remove pressure for service and maintenance operations. Though this embodiment shows the pressure release channel 315 as extending from the main input channel 300 to the front surface 36, in other embodiments, the pressure release channel 315 may extend from the main input channel 300 to surfaces of the manifold 12 other than the front surface 36.

As the main input channel 300 extends through the manifold 12, it extends through each of the manifold segments 22 (e.g., manifold segments 22*a*, 22*b*, and 22*c* in FIG. 15) that comprise the manifold 12. As such, each of the manifold segments 22*a*-22*c* defines a portion of the main input channel 300. The remote metering station 10 includes O-rings 323 between each adjacent manifold segment 22 to create a tight seal between the manifold segments 22 and prevent adhesive from leaking out of the main input channel 300 into spaces between the manifold segments 22. As each of the modular pump assemblies 20*a*-20*c* is detachable from the remote metering station 10, each of the manifold segments 22*a*-22*c* are also detachable from the remote metering station 10. An operator can detach and replace a manifold segment 22 due to damage, wear, or for cleaning, or to accommodate a new modular pump assembly 20 of a different size. Also, the operator can take away manifold segments 22 or add additional manifold segments 22 to accommodate a decrease or increase in the number of modular pump assemblies 20 attached to the remote metering station 10. As such, the main input channel 300 is defined by the particular arrangement of manifold segments 22 that are mounted to the manifold 12 at any given time.

Figure 16:
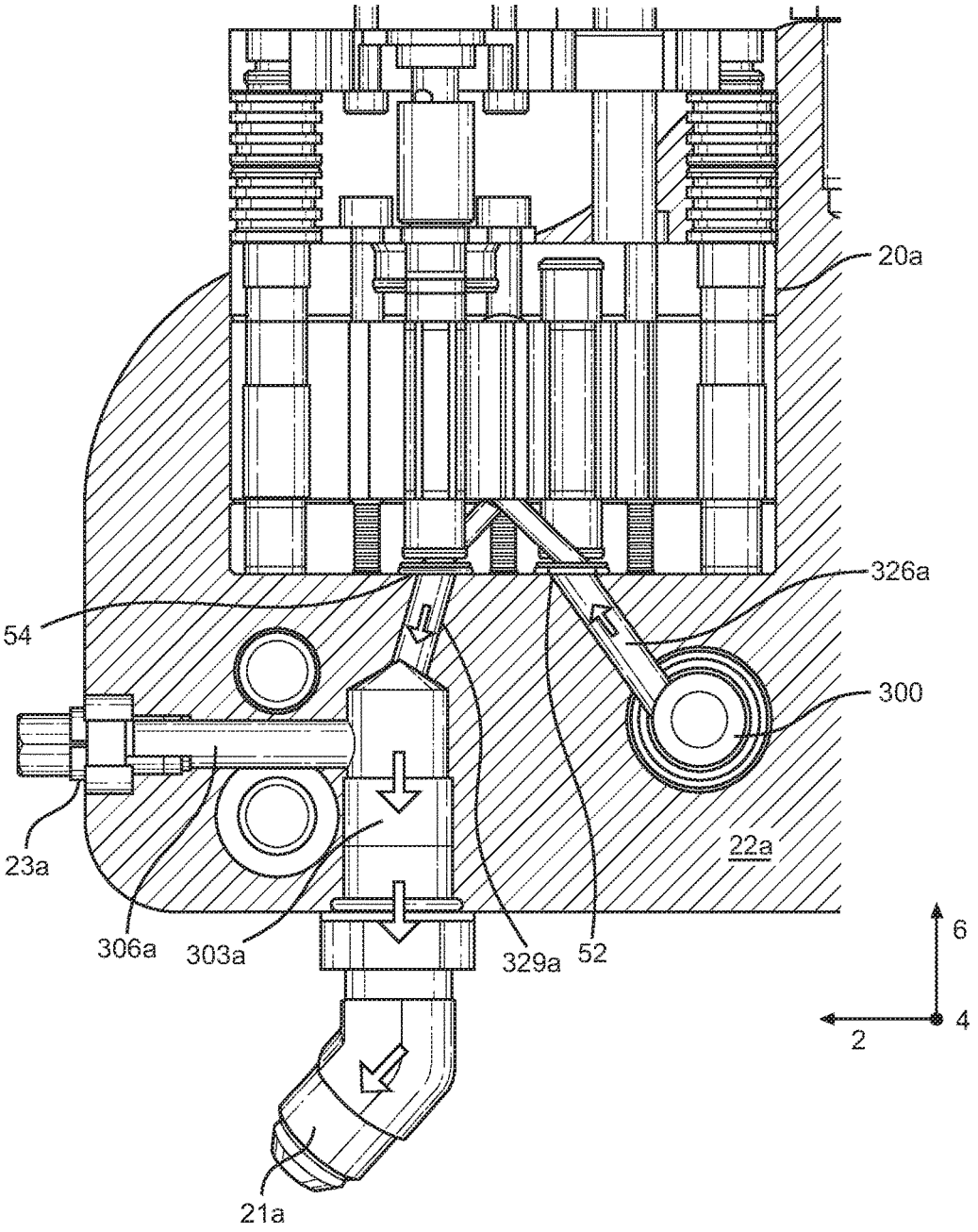
FIG. 16 is a vertical sectional view of the remote metering station shown in FIG. 1.

With reference to FIGS. 15-16, each manifold segment 22 includes a flow path that connects the modular pump assembly 20 to the main input channel 300, as well as the modular pump assembly 20 to the output connector 21. For simplicity, the cross section of manifold segment 22*a* depicted in FIG. 16 will be described, as the manifold segment 22*b* including output channel 303*b*, and the manifold segment 22*c* including output channel 303*c* may be similarly configured. Manifold segment 22*a* defines a first pump input channel 326*a* that directs a flow of adhesive from the main input channel 300 to the inlet 52 of the modular pump assembly 20*a*. From there, adhesive is pumped through the modular pump assembly 20*a*, and out of the modular pump assembly 20*a* through the outlet 54. Once the adhesive exits outlet 54, the adhesive enters the first pump output channel 329*a*, which is defined by the manifold segment 22*a*. Then, the adhesive flows into the output channel 303*a*, which connects the first pump output channel 329*a* to the output connector 21*a*. The output connector 21*a* directs the adhesive flow to an applicator or dispensing module 450 or 460, as will be described below. The manifold segment 22*a* also defines a pressure sensing channel 306*a* that extends from the output channel 303*a* to the front surface 36. The pressure port plug 23*a* is positioned at the opening of the pressure sensing channel 306*a* at the front surface 36*a*, and may be removed from the remote metering station 10 to provide access to the pressure sensing channel 306*a*. External access to the pressure sensing channel 306*a* may be desired to add a pressure sensor (not shown) for indicating the adhesive pressure being supplied to the applicator or dispensing module 450 or 460.

Figure 17:
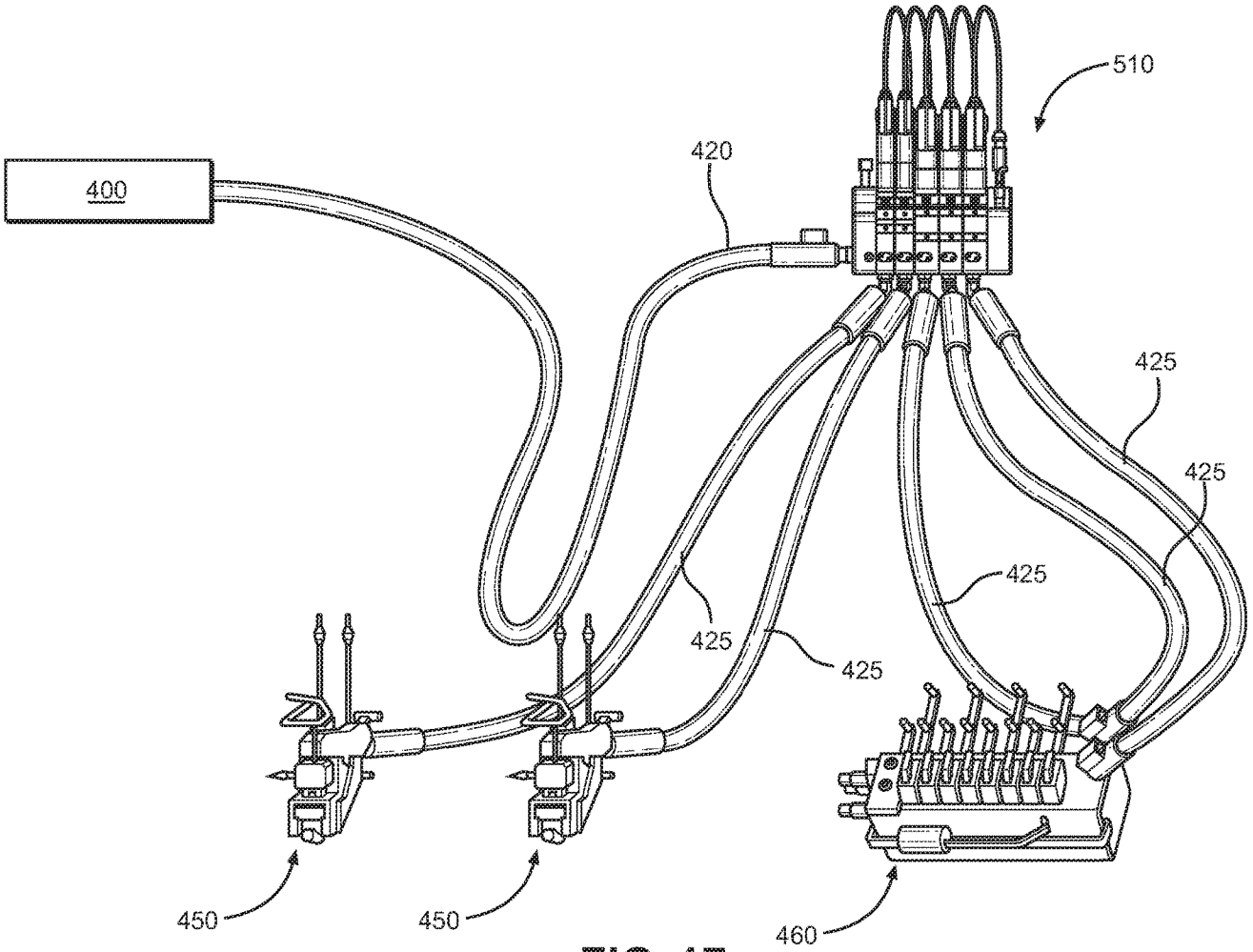
FIG. 17 is a view of the remote metering station as part of an applicator system.

Now referring to FIG. 17, a remote metering station 510 can be connected to a plurality of dispensing modules, such as dispensing modules 450 and 460. The remote metering station 510 is substantially the same as the remote metering station 10, with the exception that the remote metering station 510 is depicted as including five modular pump assemblies 20, whereas remote metering station 10 includes three modular pump assemblies 20. However, the disclosure related to remote metering station 510 is equally applicable to remote metering station 10. The remote metering station 510 pumps adhesive to dispensing modules 450 and 460 through hoses 425, which attach to the output connectors 21*a*-21*c*. As shown in FIG. 17, the remote metering station 10 may pump adhesive to multiple types of dispensing modules 450 and 460 simultaneously. In one embodiment, the dispensing module 450 comprises an adhesive applicator with a contact nozzle, and the dispensing module 460 comprises an adhesive applicator with a non-contact nozzle. However, the dispensing modules 450 and 460 may include any type of dispensing module, which may be interchanged as desired by an operator of the remote metering station, depending upon the substrate to which the adhesive is being applied and the method of application of the adhesive. While the dispensing modules 450 and 460 may be detached and replaced in isolation, the modular pump assemblies 20 and 220 may simultaneously be detached from the remote metering station 10 and replaced. Alternatively, the modular pump assemblies 20 and 220 can be replaced to accommodate a new dispensing operation, while the dispensing modules 450 and 460 are maintained in place. Operation of the modular pump assemblies 20 and 220 can also be altered by the operator without replacing the modular pump assemblies 20 and 220 to accommodate a new dispensing operation, as will be discussed below.

The pump assemblies 20 and 220 as described herein can be independently controlled. For instance, the control system 110 may be used to independently adjust the revolutions per minute (RPM) of the output motor shaft 66 of the drive motor unit 60. Changes in the RPM of the drive motor unit 60 may vary the volumetric flow rate of the pump assembly 20, and thus the flow rate of the adhesive exiting the output connectors 21 of the remote metering station 10. Accordingly, each stream of adhesive exiting the remote metering station 10 may be individually controlled by adjusting the RPM of the drive motor unit 60. For example, in a remote metering station 10 including a first modular pump assembly 20 pumping adhesive at a first volumetric flow rate and a second modular pump assembly pumping adhesive at a second volumetric flow rate, the control unit 150 may transmit a signal to either of the first or second modular pump assemblies that directs the modular pump assembly 20 to pump adhesive at a third volumetric flow rate. The first, second, and third volumetric flow rates may all be different. As such, independent adjustment or control of the flow rate at each pump assembly 20 is possible without having to change the pump. Furthermore, the pump assemblies 20 have a wide range of flow rates for a given range of RPM compared to conventional pumps used in adhesive applicators. In other words, one pump assembly 20 as described herein has an effective operating range that encompasses the operating ranges of two or more convention pumps designed for adhesive applicators. Furthermore, such an operating range of the modular pump assembly 20 is possible in a compact size.

In conventional pumps used with hot-melt adhesives, it is necessary to change the pumps to vary the flow rate outside of certain operating ranges. For example, one gear set within a pump may be designed for a range of flow rates given a set of input rotational speeds. To achieve higher flow rates (or lower flow rates), a different pump with a gear set designed for higher (or lower) flow rates must be used. Table 1 below includes the volumetric flow rates in cubic centimeters per minute (cc/min) for a conventional small pump ("Pump 1"), a conventional large pump ("Pump 2") and the pump assemblies 20 and 220 as described in the present disclosure. Pump 1 in the table below has a cubic centimeter per revolution (cc/rev) of 0.16. Pump 2 in the table below has a cc/rev of 0.786. The "pump assembly" in the table below has a cc/rev of 0.34. Pump 1 and Pump 2 are representative of the smaller sized pumps and the larger (or largest) sized pumps, respectively, used in conventional adhesive applicators.

TABLE 1

| RPM | Pump 1 (0.16 cc/rev) | Pump 2 (0.786 cc/rev) | Pump Assembly (0.34 cc/rev) |
|---|---|---|---|
| 10 | 1.6 | 7.86 | 3.4 |
| 20 | 3.2 | 15.72 | 6.8 |
| 30 | 4.8 | 23.58 | 10.2 |
| 40 | 6.4 | 31.44 | 13.6 |
| 50 | 8 | 39.3 | 17 |
| 60 | 9.6 | 47.16 | 20.4 |

TABLE 1-continued

| RPM | Pump 1 (0.16 cc/rev) | Pump 2 (0.786 cc/rev) | Pump Assembly (0.34 cc/rev) |
|---|---|---|---|
| 70 | 11.2 | 55.02 | 23.8 |
| 80 | 12.8 | 62.88 | 27.2 |
| 90 | 14.4 | 70.74 | 30.6 |
| 100 | 16 | 78.6 | 34 |
| 110 | 17.6 | 86.46 | 37.4 |
| 120 | 19.2 | 94.32 | 40.8 |
| 130 | 20.8 | 102.18 | 44.2 |
| 140 | 22.4 | 110.04 | 47.6 |
| 150 | 24 | 117.9 | 51 |
| 160 | | | 54.4 |
| 170 | | | 57.8 |
| 180 | | | 61.2 |
| 190 | | | 64.6 |
| 200 | | | 68 |
| 210 | | | 71.4 |
| 220 | | | 74.8 |
| 230 | | | 78.2 |
| 240 | | | 81.6 |
| 250 | | | 85 |
| 260 | | | 88.4 |
| 270 | | | 91.8 |
| 280 | | | 95.2 |
| 290 | | | 98.6 |
| 300 | | | 102 |

As can be seen in the table above, the pump assemblies 20 and 220 as described herein have a wide range of volumetric flow rates for a given range of motor RPM's. For pump speeds of 10-150 rpm, the volumetric flow rate for Pump 1 ranges from 1.6 to 24 cc/min, and the volumetric flow rates for Pump 2 ranges from 7.86 to 117.9 cc/min. The pump assemblies 20 and 220 can provide a range of volumetric flow rates that is as wide as the flow rates of two different conventional pumps (Pumps 1 and 2), at a wide range of pump speeds. In other words, the pump assemblies 20 and 220 are operable to provide a volumetric flow rate that current typical pumps require two different pumps to accomplish. This results in greater process flexibility because each pump assembly can be separately controlled to provide a targeted flow volumetric among a wider range of possible volumetric flow rates. Furthermore, this level of control, and possible variation, is possible across multiple pumps and adhesive streams.

Furthermore, the pump assemblies 20 and 220 offer the operator more in-process flexibility. In conventional pumps used with hot-melt adhesives, the only way to change or adjust the RPM of the pumps is to the change the RPM of the common drive shaft driving each pump. Because a common drive shaft is used to drive the pumps, different pumps are used across the width of the applicator in order to vary the flow rate across the width of the applicator. Increasing (or decreasing) the RPM of the common drive draft results in the same increase (or decrease) in flow rates (same percentage of change across all pumps, but actual flow rate of each is dependent upon pump size at each location) across all of the pumps. Thus, conventional pump designs limit the ability to adjust process parameters, such as volumetric flow rate. Rather, to change flow rates outside the desirable operating ranges of the pumps installed on the machine, the conventional pumps must be replaced with the pumps sized for the application. As discussed above, replacing conventional pumps is time intensive and complex. The remote metering station 10 as described herein allows for individual pump control while also minimizing removal/replacement times.

There are several additional advantages to using the remote metering station 10. Because the modular pump assemblies 20 are releasably attached to the remote metering station 10, the controller of the remote metering station 10 is provided with greater flexibility as to the type of adhesive flow that can be produced. For example, with reference to FIGS. 1-11, in one embodiment, the modular pump assembly 20*a* may have a range of volumetric flow ranges that can be produced. In contrast, modular pump assembly 20 may have a different range of volumetric flow ranges that can be produced. This demonstrates that modular pump assemblies 20 with different possible volumetric flow rate ranges can be utilized simultaneously in a single remote metering station 10, particularly due to the fact that each modular pump assembly 20 has a dedicated drive motor unit 60. As such, a single remote metering station 10 can be used to provide a flow of adhesive to different dispensing modules, such as dispensing modules 450 and 460, that have different volumetric flow rate requirements.

The remote metering station 10 can also be used to split adhesive output streams from a melter, such as the melter 400. In conventional systems, one melter may be capable of providing enough output adhesive to supply a plurality of dispensing modules 450 and 460. However, conventionally, in order to add additional dispensing modules, an additional melter 400 would have to be purchased. The remote metering station 10 allows existing outputs from a melter 400 to be split to supply additional dispensing modules 450 and 460 and is, therefore, a more economical alternative to purchasing an additional melter 400.

Yet another advantage to using the remote metering station 10 is that because each of the modular pump assemblies has a dedicated drive motor unit 60, additional modular pump assemblies 20 operating at an elevated RPM can be added to an existing remote metering unit without affecting the operation of the modular pump assemblies 20 in operation. Conventional pumps operating in a pump system are operated by a common drive shaft. Though an additional pump may be added, it would require increasing the RPM and volumetric flow rate of the additional pump's motor. This is not feasible in conventional pump assemblies, as conventional pump assemblies employ a common drive shaft. As such, increasing the RPM and volumetric flow rate of the additional pump would likewise increase the RPM and volumetric flow rate of every other pump, thus adversely affecting the dispensing operation of each dispensing module that the existing pumps supply with adhesive.

Further, the remote metering station 10 allows an operator of an adhesive dispensing operation to maintain better control over the pressure of the adhesive from the melter to the dispensing modules. Typically, melters are physically located several meters from the dispensing modules that they supply. As adhesive travels this distance through the hoses, the pressure of the adhesive within the hoses is lowered. As a result, once the adhesive reaches the dispensing module, the adhesive is no longer flowing at the desired pressure. By attaching the remote metering station 10 between the melter and the dispensing module, at a location closer to the dispensing module than the melter, the remote metering station 10 can ensure that adhesive pressure is maintained throughout the flow of adhesive and accuracy of the adhesive pressure is maintained all the way to the dispensing module.

While the invention is described herein using a limited number of embodiments, these specific embodiments are not intended to limit the scope of the invention as otherwise described and claimed herein. The precise arrangement of various elements and order of the steps of articles and methods described herein are not to be considered limiting. For instance, although the steps of the methods are described with reference to sequential series of reference signs and progression of the blocks in the figures, the method can be implemented in a particular order as desired.

What is claimed is:

1. A remote metering station for pumping a flow of adhesive to a dispensing module, the remote metering station comprising:

a manifold having a front surface, a back surface opposite to the front surface, a first side surface, and a second side surface opposite the first side surface;

a modular pump assembly removably mounted to said manifold, said modular pump assembly comprising:

a bottom surface;

an outlet on said bottom surface, said outlet being in fluid communication with said manifold;

an inlet for receiving the adhesive;

a gear assembly; and a drive motor coupled to said gear assembly and operable for pumping the adhesive from said inlet to said outlet, said drive motor having a shaft, said shaft having an axis that intersects said bottom surface, and does not intersect either of said first side surface or said second side surface;

a control unit; and a rotational sensor coupled to said control unit and said drive motor, said rotational sensor configured to provide data indicative of an actual rotation speed of said drive motor to said control unit, said control unit configured to receive data indicative of a target rotational speed of said drive motor, said control unit configured to a) determine an extent of a variance between the target rotational speed of said drive motor and the actual rotational speed of said drive motor, and b) adjust the rotational speed of said drive motor to reduce the variance.

2. The remote metering station of claim 1, wherein said axis of said shaft is aligned with a plane that is parallel to said first side surface and said second side surface.

3. The remote metering station of claim 1, wherein said gear assembly comprises a gear with an outer diameter and a length that is greater than or equal to said outer diameter.

4. The remote metering station of claim 1, wherein said modular pump assembly further includes a thermal isolation region between said gear assembly and said drive motor.

5. A remote metering station for pumping a flow of adhesive to a dispensing module, the remote metering station comprising:

a manifold having a front surface, a back surface opposite to the front surface, a first side surface, and a second side surface opposite the first side surface; and first and second modular pump assemblies removably mounted to said manifold, each of said first and second modular pump assemblies comprising:

a bottom surface;

an outlet on said bottom surface, said outlet being in fluid communication with said manifold;

an inlet for receiving the adhesive;

a gear assembly; and a drive motor coupled to said gear assembly and operable for pumping the adhesive from said inlet to said outlet, said drive motor having a shaft, said shaft having an axis that intersects said bottom surface, and does not intersect either of said first side surface or said second side surface, wherein said drive motor of said first modular pump assembly is configured to pump the adhesive through said outlet of said first modular pump assembly at a first volumetric flow rate, and said drive motor of said second modular pump assembly is configured to pump the adhesive through said outlet of said second modular pump assembly at a second volumetric flow rate that is different than said first volumetric flow rate.

6. The remote metering station of claim 5, wherein the first volumetric flow rate is different than the second volumetric flow rate.

7. The remote metering station of claim 6, further comprising a control unit that is configured to transmit a signal to said first modular pump assembly, such that the signal directs said drive motor of said first modular pump assembly to pump the adhesive through said outlet of said first modular pump assembly at a third volumetric flow rate.

8. The remote metering station of claim 7, wherein the third volumetric flow rate is different than the first and second volumetric flow rates.

9. The remote metering station of claim 5, wherein said first modular pump assembly is capable of pumping adhesive through the outlet of said first modular pump assembly at a first maximum volumetric flow rate, and said second modular pump assembly is capable of pumping adhesive through said outlet of said second modular pump assembly at a second maximum volumetric flow rate, wherein the first maximum volumetric flow rate is different than the second maximum volumetric flow rate.

10. The remote metering station of claim 5, further comprising:

a first hose configured to receive the adhesive from said outlet of said first modular pump assembly and provide the adhesive to said dispensing module spaced from the manifold; and a second hose configured to receive the adhesive from said outlet of said second modular pump assembly and provide the adhesive to said dispensing module.

11. The remote metering station of claim 5, wherein said dispensing module comprises a first dispensing module and a second dispensing module, the remote metering station further comprising:

a first hose configured to receive the adhesive from said outlet of said first modular pump assembly and provide the adhesive to said first dispensing module spaced from said manifold; and a second hose configured to receive the adhesive from said outlet of said second modular pump assembly and provide the adhesive to said second dispensing module spaced from said first dispensing module and said manifold.

12. The remote metering station of claim 5, wherein said axis of said shaft of said first modular pump assembly is aligned with a first plane that is parallel to said first side surface and said second side surface of said first modular pump assembly, wherein said axis of said shaft of said second modular pump assembly is aligned with a second plane that is parallel to said first side surface and said second side surface of said second modular pump assembly.

13. The remote metering station of claim 5, wherein said gear assembly of each of said first and second modular pump assemblies comprises a gear with an outer diameter and a length that is greater than or equal to said outer diameter.

14. The remote metering station of claim 5, wherein each of said first and second modular pump assemblies further includes a thermal isolation region between said gear assembly and said drive motor.

15. The remote metering station of claim 5, wherein said manifold includes first and second manifold segments, wherein said first manifold segment is attached to said first modular pump assembly and said second manifold segment is attached to said second modular pump assembly.

* * * * *